US007396253B2

(12) United States Patent
Nakamura

(10) Patent No.: US 7,396,253 B2
(45) Date of Patent: Jul. 8, 2008

(54) CONNECTOR AND A CONNECTOR ASSEMBLY

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/801,471

(22) Filed: May 10, 2007

(65) Prior Publication Data

US 2007/0264863 A1 Nov. 15, 2007

(30) Foreign Application Priority Data

May 15, 2006 (JP) ..... 2006-135606

(51) Int. Cl.
*H01R 3/00* (2006.01)

(52) U.S. Cl. ..... 439/489; 439/188; 439/352

(58) Field of Classification Search ..... 439/489, 439/188, 352

See application file for complete search history.

(56) References Cited

U.S. PATENT DOCUMENTS 6,102,732 A 8/2000 Seko et al.
6,439,915 B2 * 8/2002 Kurimoto ..... 439/352
6,530,799 B2 * 3/2003 Regnier et al. ..... 439/352
7,229,305 B2 * 6/2007 Hirschmann ..... 439/352

FOREIGN PATENT DOCUMENTS

JP 2005-166575 6/2005

* cited by examiner

*Primary Examiner*—Truc T Nguyen
(74) *Attorney, Agent, or Firm*—Gerald E. Hespos; Anthony J. Casella

(57) ABSTRACT

A connector has female and male housings (10, 80) and a detector (50) that can move from a preventing position to a locking position on the female housing (10). Preventing portions (57) of the detector (50) engage retainers (59) of the female housing (10) if the detector (50) is pushed towards the locking position before the housings (10, 80) are connected. Detector lock arms (52) slide in contact with interfering portions (89) of the male housing (80) and deform if the detector (50) is pushed towards the locking position when the housings (10, 80) are connected. Thus, the preventing portions (57) separate from the retainers (59) and the detector (50) can move to the locking position as the detector lock arms (52) deform. The detector lock arms (52) restore and engage interlocking portions (88) of the male housing (80) as the detector (50) reaches the locking position.

11 Claims, 25 Drawing Sheets

CONNECTOR AND A CONNECTOR ASSEMBLY

BACKGROUND OF THE INVENTION

1. Field of the Invention

The invention relates to a connector and to a corresponding connector assembly.

2. Description of the Related Art

U.S. Pat. No. 6,102,732 discloses a connector with two housings that are connectable with each other and a detector assembled into one housing to detect a connected state of the housings. A retainer is mounted in one housing and has a resiliently deformable lock arm to lock the housings together. A detecting piece of the detector is insertable into a deformation area of the lock arm. The lock arm remains deformed when the two housings are connected only partly. As a result, the detecting piece interferes with the lock arm and restricts a pushing movement of the detector. On the other hand, the lock arm restores resiliently to its natural state and opens a moving path for the detecting piece, when the housings are connected properly, thereby permitting the detector to be pushed. Thus, the connected state of the housings can be detected based on whether the detector can be pushed.

The above-described detector can be pushed if the lock arm is in its natural state. However, there have been cases where the detector already has reached a push-in position before the connecting operation of the two housings is started. The detector then must be returned to an initial position at an operation site, taking time and labor. Further, the detector must be pushed after the connecting operation of the two housings is completed, i.e. two actions are needed. Therefore, there has been also a problem of a cumbersome operation.

The invention was developed in view of the above problems, and objects are to prevent a detector from being pushed in before the housings are connected and enabling connection of the housings to be performed efficiently.

SUMMARY OF THE INVENTION

The invention relates to a connector with a housing that is connectable with a mating housing of a mating connector. At least one detector is assembled into the housing for detecting the connected state of the housing with the mating housing. At least one housing lock arm is provided for locking the housing with the mating housing. The housing lock arm is engageable with an interlocking portion in the mating housing when the housings are connected properly. The detector can be pushed in a push-in direction between a first position and a second position relative to the housing. The detector has at least one detector lock arm substantially adjacent to the housing lock arm in an assembled state of the detector. The housing has at least one retainer to engage at least one push-in preventing portion on the detector lock arm to prevent movement of the detector from the first position to the second position. The push-in preventing portion engages the retainer and prevents the detector from being pushed from the first position to the second position before the housing is connected properly with the mating housing. The detector lock arm is resiliently deformable while sliding contact with at least one interfering portion in the mating housing if the detector is pushed towards the second position when the housing is connected properly with the mating housing. The push-in preventing portion separates from the retainer and the detector can be moved towards the second position as the detector lock arm deforms. The detector lock arm is restored to a position substantially adjacent to the housing lock arm and is engageable with the interlocking portion together with the housing lock arm as the detector reaches the second position.

The push-in preventing portion and the retainer engage to prevent the detector from being pushed to the second position before the housings are connected properly. Thus, the detector cannot be pushed accidentally to the second position during transportation. On the other hand, the detector lock arm can deform to disengage the push-in preventing portion from the retainer when the two housings are connected properly so that the detector can be pushed to the second position. Thus, the connected state of the two housings can be detected depending on whether the detector can be moved.

The detector lock arm restores to a position adjacent the housing lock arm as the detector reaches the second position and both the detector lock arm and the retainer lock arm engage the interlocking portion. Thus, even if one of the detector lock arm and the housing lock arm accidentally disengages from the interlocking portion, the remaining lock arm keeps the two housings locked together. As a result, inadvertent separation of the housings is hindered.

The connected state of the housings is detected by pushing the detector in the pushing direction and is substantially parallel to the connecting direction. Thus, connection of the housings can be performed while the detector is being pushed, and it is not necessary to perform the connecting operation of the housings separately from the push-in operation of the detector.

Outer surfaces of the detector lock arm and the housing lock arm are substantially flush and continuous with the each other when the detector is in the assembled state. Accordingly, external matter will not enter between the two lock arms and will not catch and deform one of the lock arms.

The detector preferably has an operable portion that can be pushed when the detector is moved to the second position. The detector lock arms project substantially in the connecting direction from opposite sides of the operable portion.

The housing preferably has a tower extending substantially in the connecting direction, and the detector arms preferably are arranged along opposite side surfaces of the tower.

The detector lock arm preferably is formed with at least one detector lock corresponding to the interlocking portion. The detector lock preferably has at least one guiding surface aligned oblique to a moving direction of the detector to the second position. The guiding surface slides in contact with at least one guide surface of the interfering portion to guide the resilient deformation of the detector lock arm when the two housings are connected properly. Relative positions of the detector and the interfering portion may displace slightly from specified positions when the detector and the interfering portion face each other during the push-in operation of the detector. However, the guiding surfaces take up such a displacement.

The detector lock arms project from opposite sides of the operable portion and interlocking portions are on the mating housing in correspondence with the detector lock arms. Thus, the housings are locked in a well-balanced manner with good locking strength and high connection reliability.

The detector preferably has at least one short canceling piece for canceling a shorted state of a shorting terminal in the mating housing when the two housings are connected.

The invention also is directed to a connector assembly comprising the above-described connector and a mating connector having a mating housing connectable with the housing of the connector.

These and other features of the invention will become more apparent upon reading the following description of preferred embodiments. It should be understood that even though embodiments are described separately, single features thereof may be combined to additional embodiments.

DETAILED DESCRIPTION OF THE PREFERRED EMBODIMENTS

Figure 1:
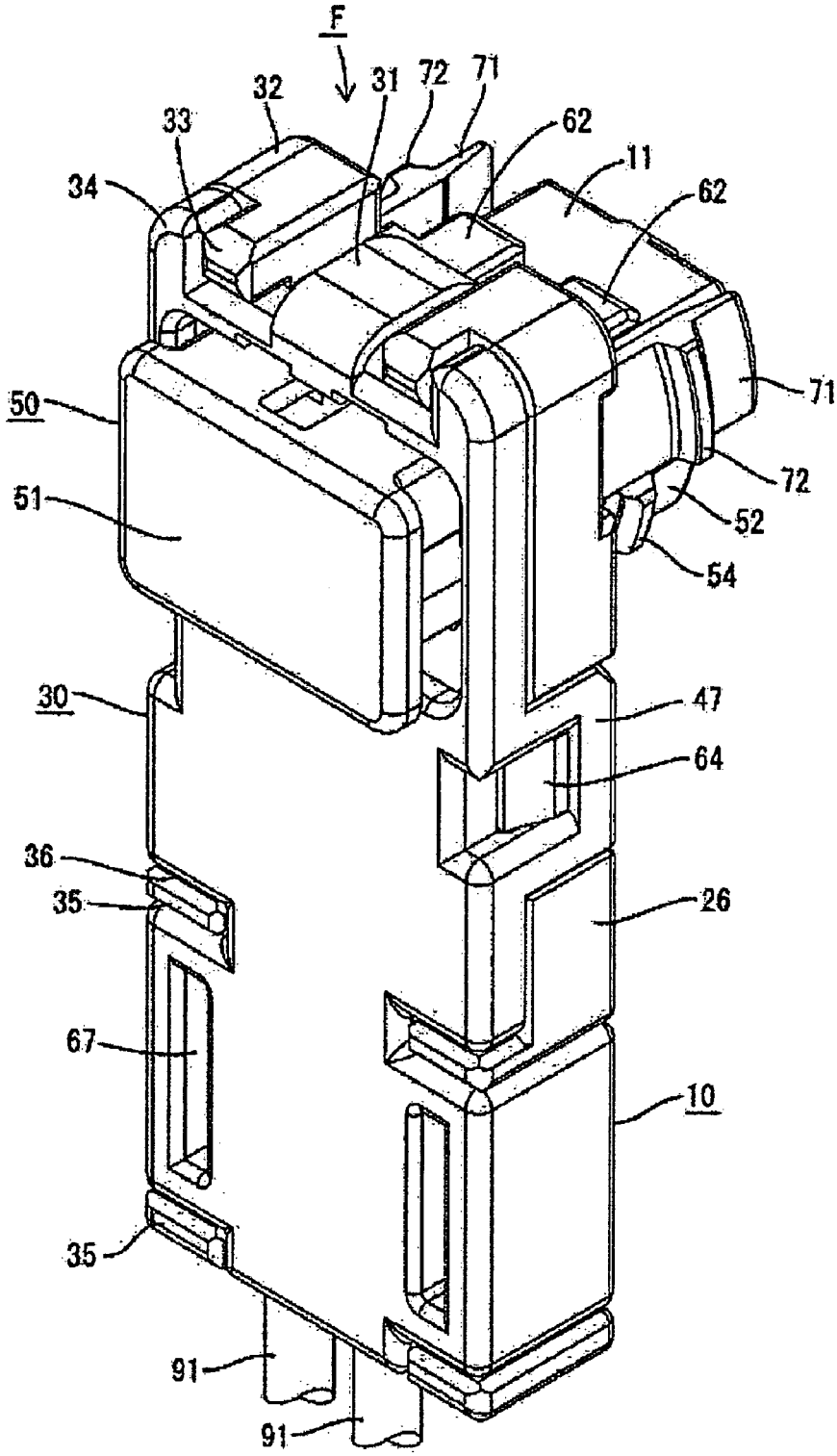
FIG. 1 is a perspective view of a female connector according to one embodiment when obliquely viewed from upper back side.
Figure 2:
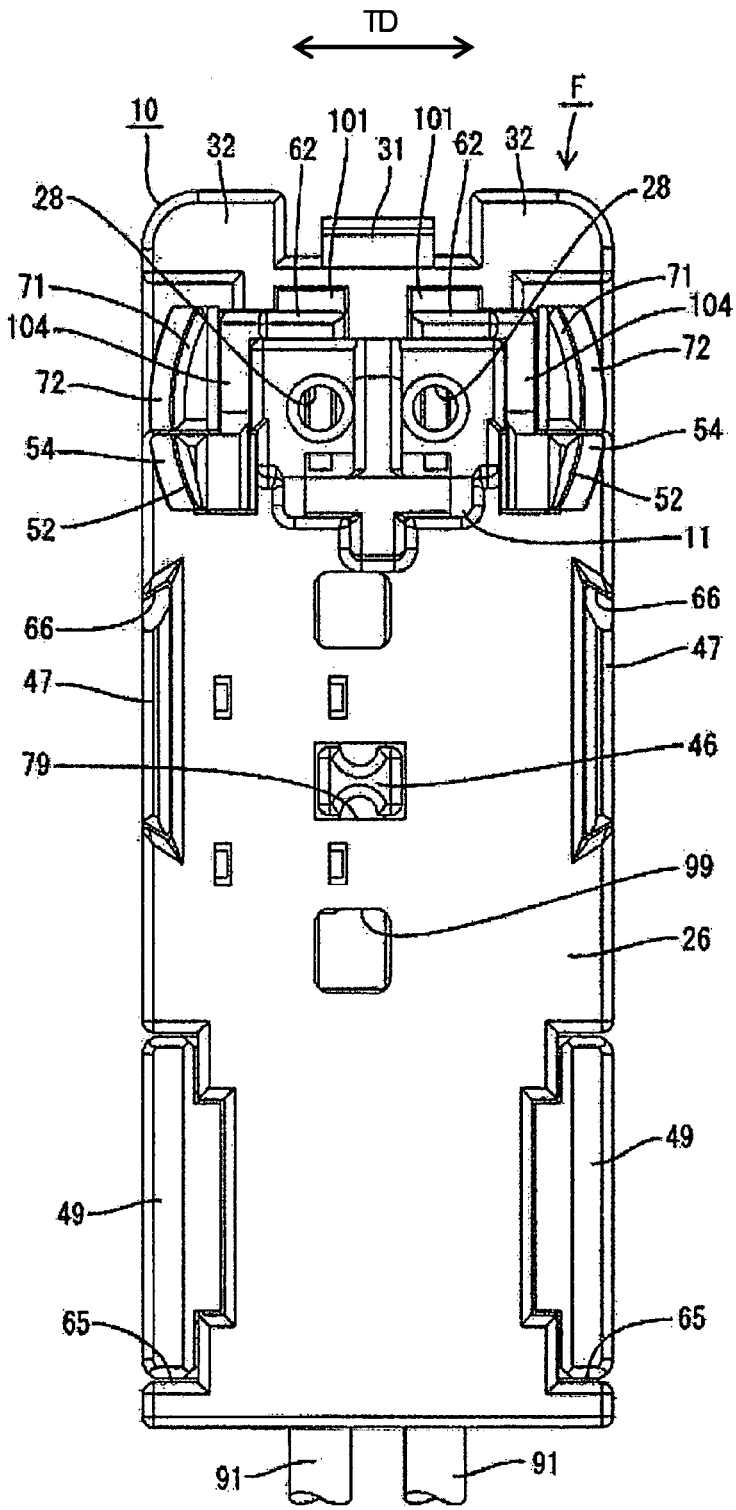
FIG. 2 is a front view of the female connector.
Figure 3:
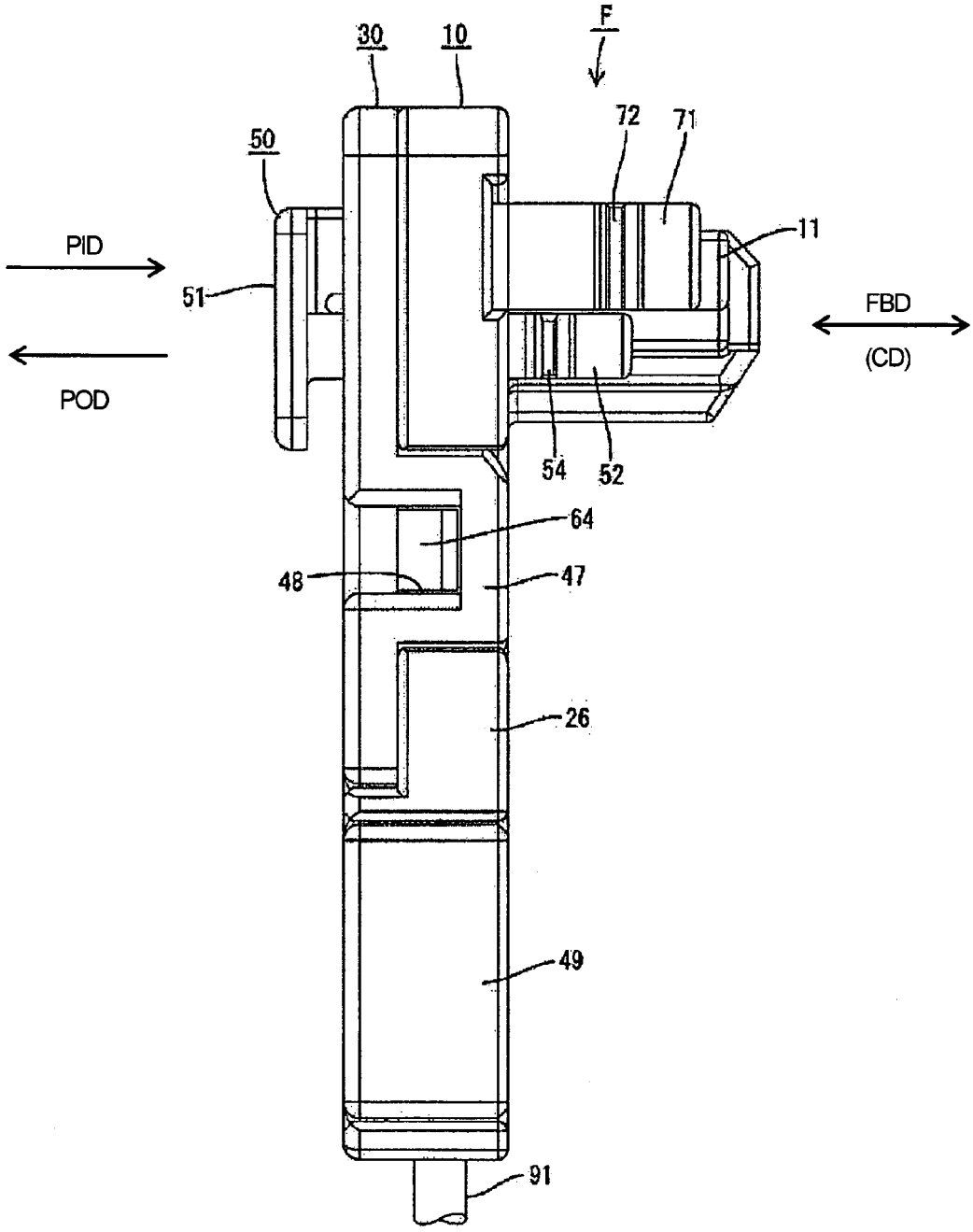
FIG. 3 is a side view of the female connector in which a detector is assembled at a push-in preventing position.
Figure 4:
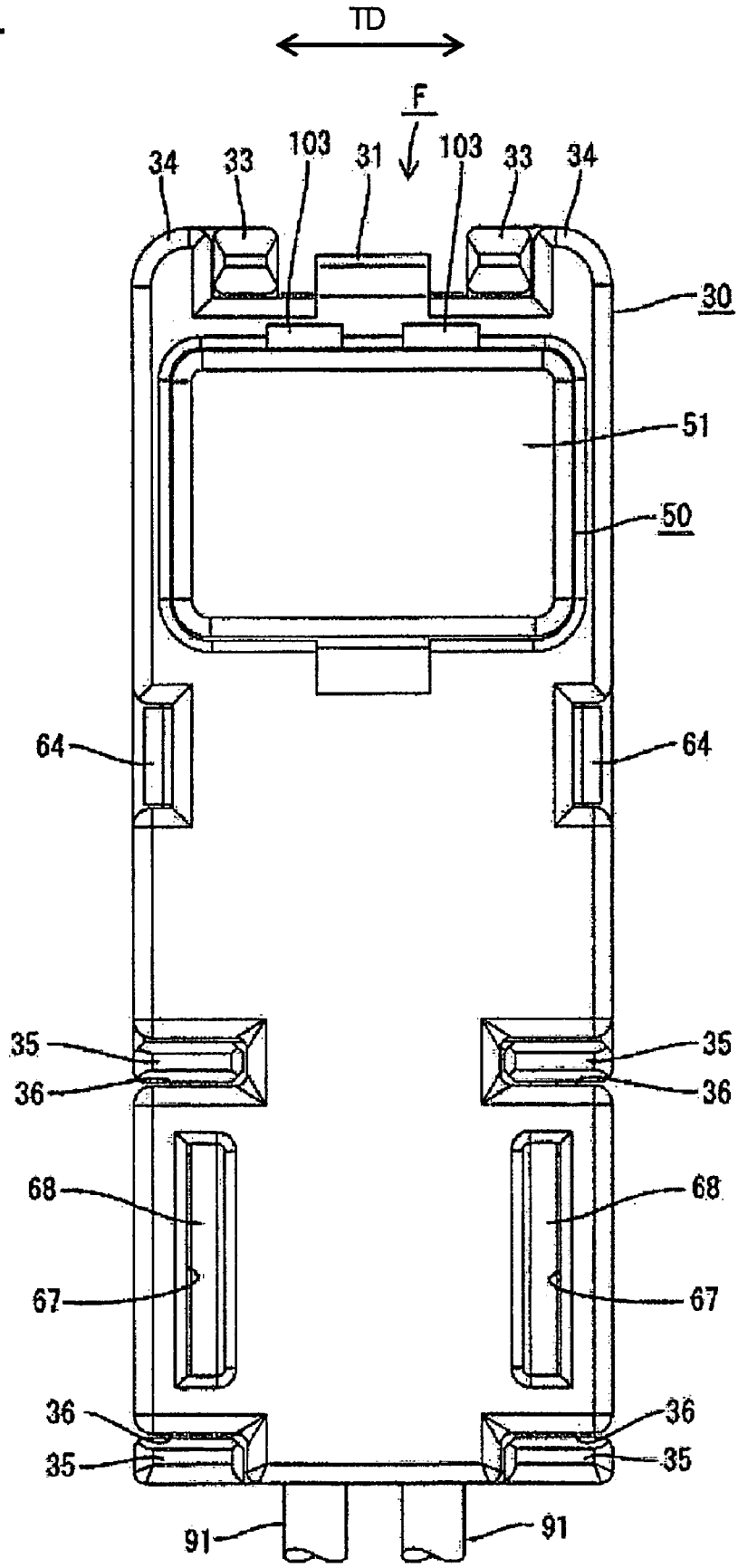
FIG. 4 is a rear view of the female connector.

A connector assembly in accordance with the invention is described with reference to the accompanying drawings. The illustrated connector assembly is for an inflator, and hence constitutes part of a circuit of an airbag device. More particularly, the connector assembly has female and male connectors F, M connectable with each other. In the following description, ends of the connectors F, M that are to be connected are referred to as the front ends and reference is made to FIG. 1 concerning the vertical direction.

Figure 18:
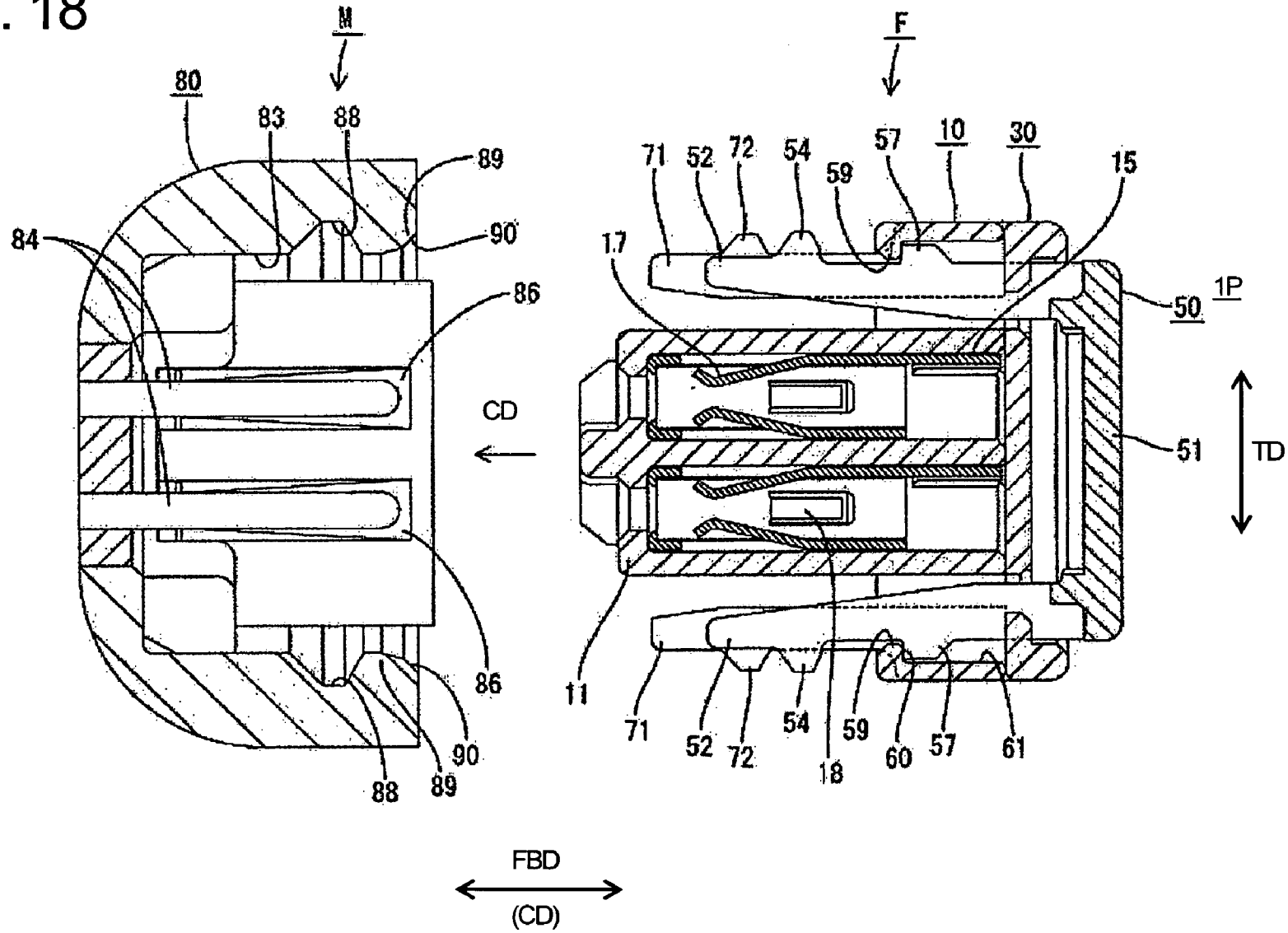
FIG. 18 is an exploded horizontal section of two connectors before being connected.
Figure 24:
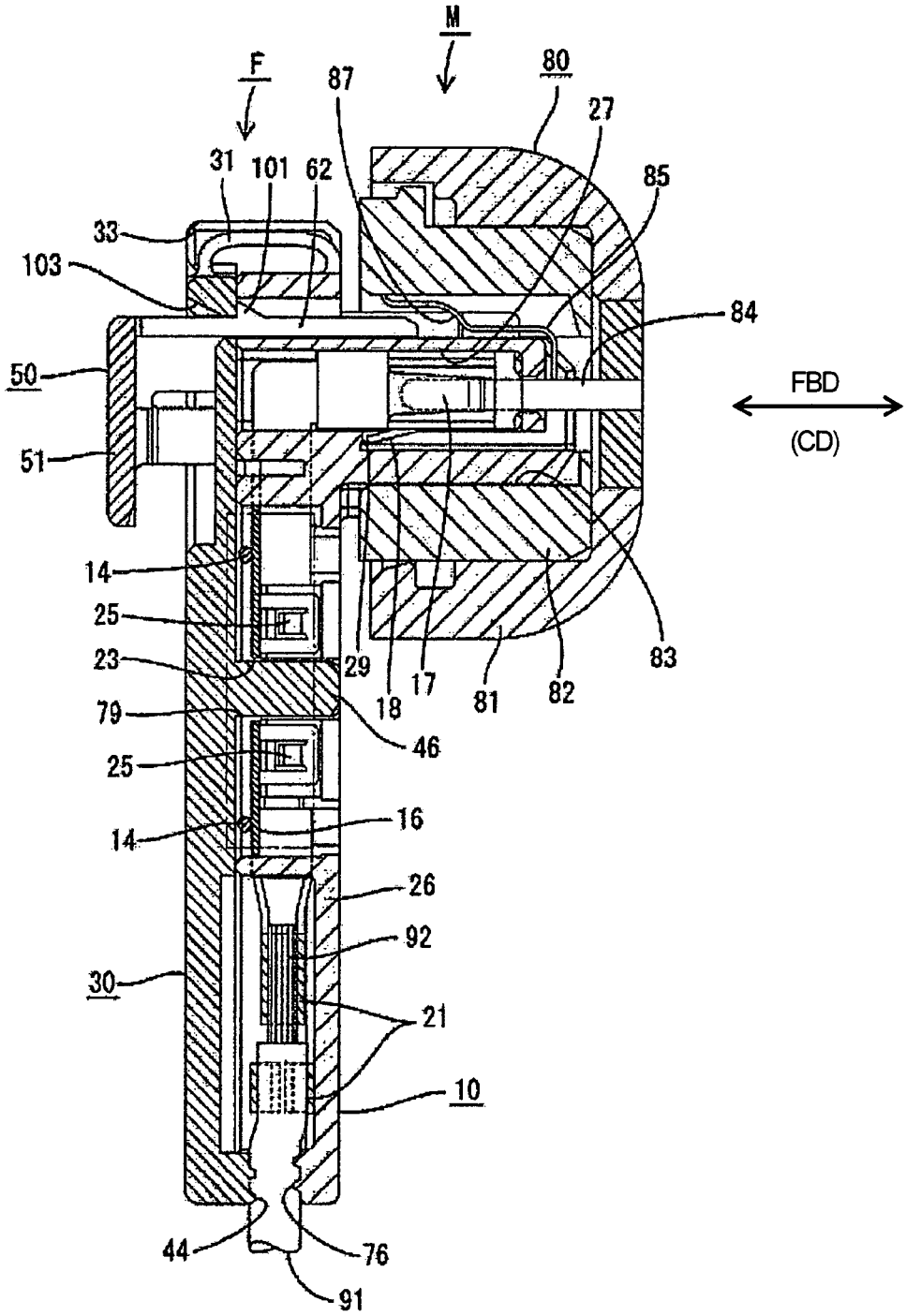
FIG. 24 is a side view in section of the two connectors properly connected with the detector held at a retracted position.
Figure 25:
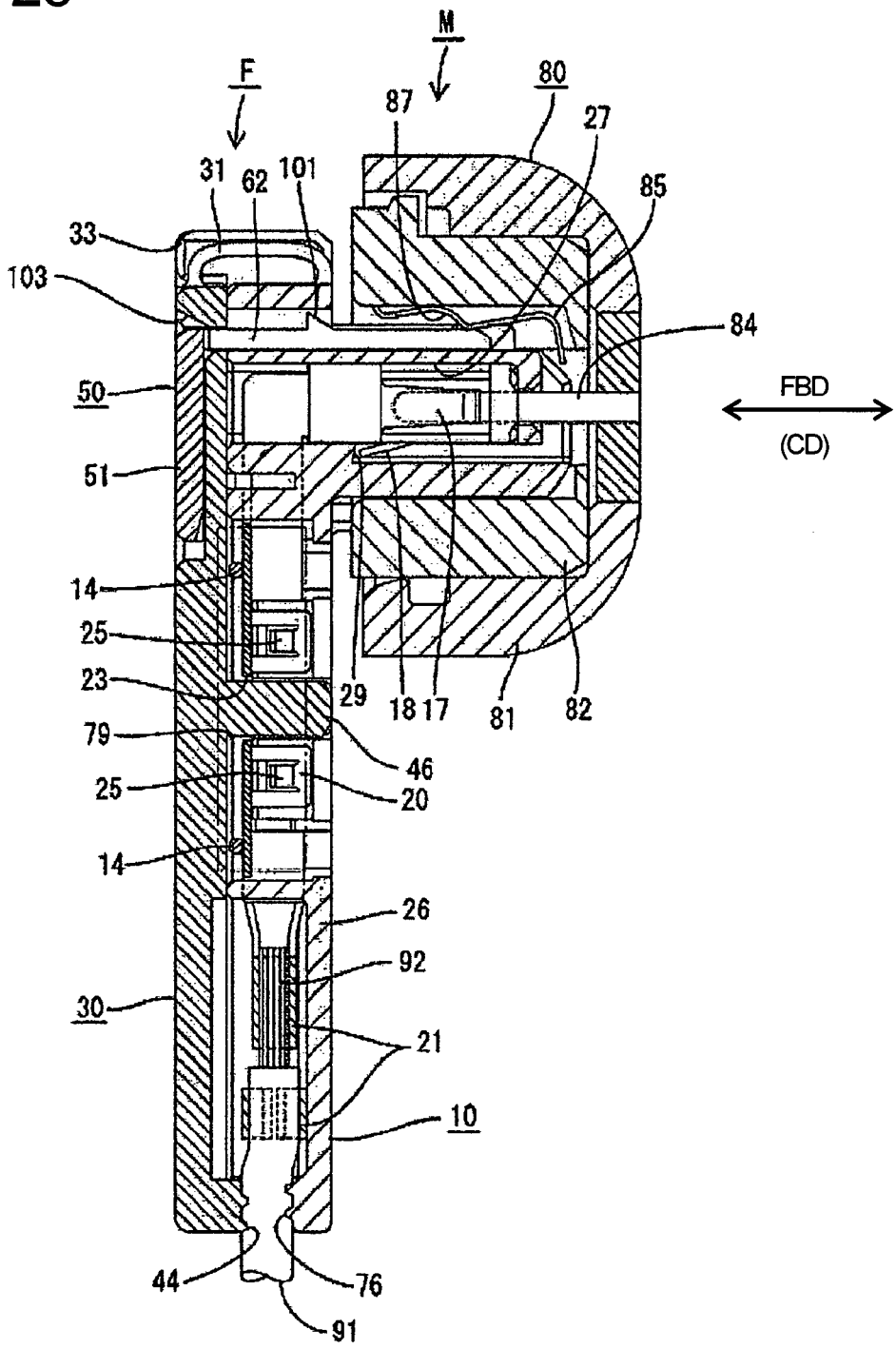
FIG. 25 is a side view in section showing a shorted state between terminal pins canceled by pushing the detector to a locking position.

The male connector M is to be connected directly with the airbag device, and includes a male housing 80 formed from a synthetic resin and projecting integrally or unitarily from a wall of the device. The male housing 80 has a substantially round shape in front view, as shown in FIGS. 18 and 24, and has a substantially round outer frame 81. An inner frame 82 is fit into the outer frame 81 and has a forwardly open fitting recess 83 for receiving part of the mating female connector F. Left and right walls of the inner frame 82 have front parts mostly cut off, and two terminal pins 84 connected with the airbag device project substantially side by side in the transverse direction TD from the back surface of the fitting recess 83.

The ceiling of the fitting recess 83 is displaced slightly inwardly to form a mounting surface for a shorting terminal 85. The shorting terminal 85 includes contact pieces 86 separated by substantially the same distance as the two terminal pins 84. Both contact pieces 86 are displaced slightly inwardly at intermediate positions and then extend back to extending ends that are bent down at substantially right angles. Slants 87 of both contact pieces 86 slope up towards the front. A part connecting the base ends of both contact pieces 86 is embedded in the front part of the mounting surface. The extending ends of the two contact pieces 86 resiliently contact the base ends of the corresponding terminal pins 84. Thus, both terminal pins 84 normally are held shorted with each other by the shorting terminal 85.

Interlocking grooves 88 are formed in opposite left and right inner surfaces of the fitting recess 83 of the male housing 80 at positions slightly distanced from the front end. The interlocking grooves 88 extend peripherally in specified ranges, and have substantially trapezoidal cross sections with oblique front and rear surfaces. The rear surfaces have a steeper angle of inclination than the front surfaces. The interlocking grooves 88 can engage with housing lock arms 71 and detector lock arms 52. One peripheral side of each interlocking groove 88, e.g. an upper side shown in FIG. 24, interlocks with the corresponding housing lock arm 71, and the other peripheral side of each interlocking groove 88, e.g. a lower side shown in FIG. 24, interlocks with the corresponding detector lock arm 52. Thus, the interlocking areas are arranged separately along height direction extending substantially normal to the forward and backward directions FBD and the connecting direction CD of the connectors F, M. Interfering portions 89 are located on the male housing 80 before the interlocking portions 88 and have left and right guiding surfaces 90 that incline to widen from one another at positions more towards the front opening edge. A guiding surface 90 of each interfering portion 89 has plural slopes with different angles of inclinations. The front slope is steeper than the rear slope so that the fitting recess 83 widens towards the opening edge. It should be noted that the slope change may be continuous or variable.

Figure 12:
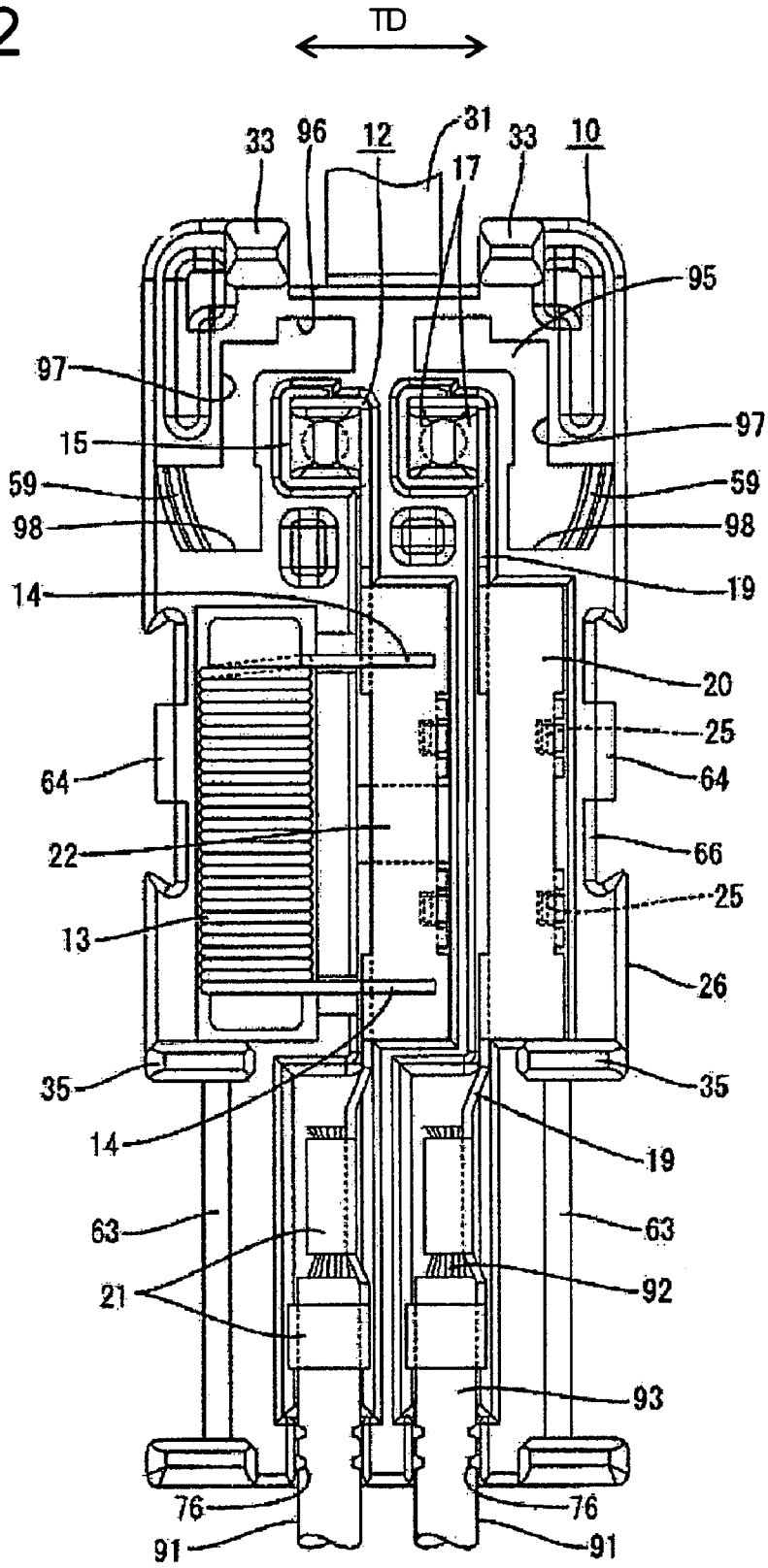
FIG. 12 is a rear view of the female housing in which a coil and terminal fittings are mounted and a breakage portion still remains in the terminal fitting.

The inflator connector is the female connector F and has a female housing 10 made e.g. of synthetic resin. A cover 30 is mountable to the rear surface of the female housing 10, and a detector 50 is provided for detecting whether the female housing 10 and the male housing 80 have been connected properly. Further, a coil 13 and female terminal fittings 12 are mounted in the female housing 10. The coil 13 functions to remove error noise and lead wires 14 extend in substantially the same direction in parallel with each other from opposite ends of the coil 13, as shown in FIG. 12.

Each terminal fitting 12 is formed by press-working, stamping, embossing, bending, folding or cutting a conductive plate (such as a copper alloy) having good electrical conductivity. Each terminal fitting 12 has a rectangular tubular terminal connecting portion 15 that extends in forward and backward directions FBD. A lead 16 extends down at an angle to the terminal connecting portion 15 so that the terminal fitting 12 defines a substantially L-shape in side view. Contact pieces 17 are embossed to project in from the left and right surfaces of the terminal connecting portion 15. The terminal pin 84 is inserted from the front into the terminal connecting portion 15 and is connected resiliently with both contact pieces 17. A resilient metal lock 18 is formed in the bottom surface of the terminal connecting portion 15 by cutting and bending.

Two mounting portions 19 in the form of busbars are arranged at opposite ends of the lead 16 with respect to the height direction and plate surfaces of the mounting portions 19 extend along forward and backward directions FBD. A widened portion 20 is located between the two mounting portions 19 with respect to the height direction and has a plate surface extending in the transverse direction TD. A piece projects forward from the extending end of the widened portion 20 to define an L-shaped. Wire connecting barrels 21 are substantially continuous with the bottom end of the lower mounting portion 19 and project toward a side opposite to the widened portion 20. The barrels 21 are connectable with a core 92 and an insulation coating 93 at an end of a wire 91. The upper end of the upper mounting portion 19 is connected to one rear edge of the terminal connecting portion 15.

Figure 13:
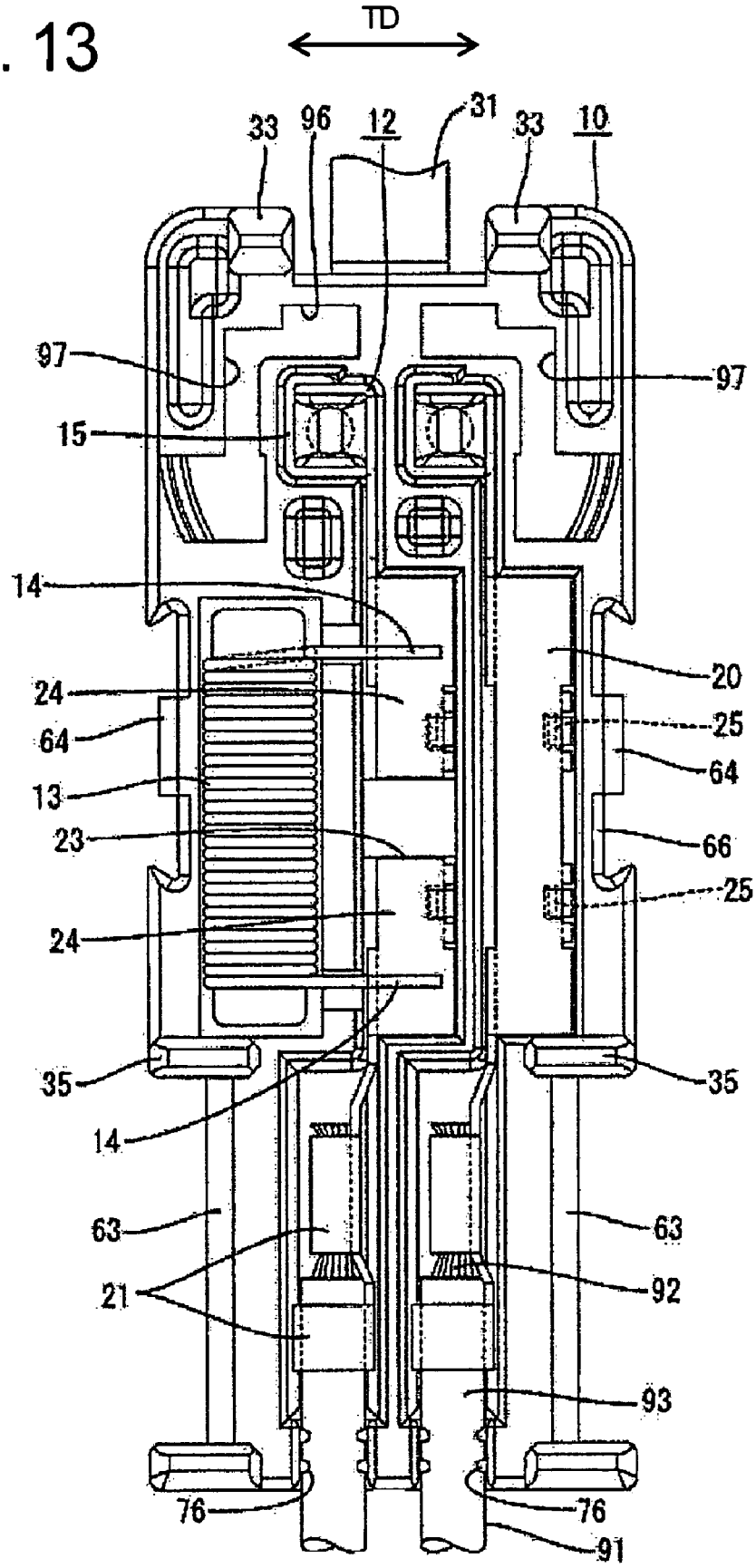
FIG. 13 is a rear view of the female housing in which the breakage portion is discarded.

One of the two terminal fittings 12 is formed at an intermediate part of the widened portion 20 with respect to the height direction with a breakage portion 22 to be cut off by a press or cutting device after the terminal fitting 12 is mounted in the female housing 10. A dividing hole 23 is formed by separating the breakage portion 22 from the widened portion 20, as shown in FIG. 13, and coil connecting portions 24 are defined at upper and lower ends of the dividing hole 23 for connection respectively with the two lead wires 14 of the coil 13. The two coil connecting portions 24 are connected electrically with each other via the coil 13. Retaining pieces 25 are formed by cutting and bending forward projecting parts of both coil connecting portions 24 for retaining the terminal fitting 12. The retaining pieces 25 incline in and toward the back with the front ends thereof as supports for resilient deformation. Retaining pieces 25 also are cut and bent in the terminal fitting 12 having no breakage portion 22.

Figure 10:
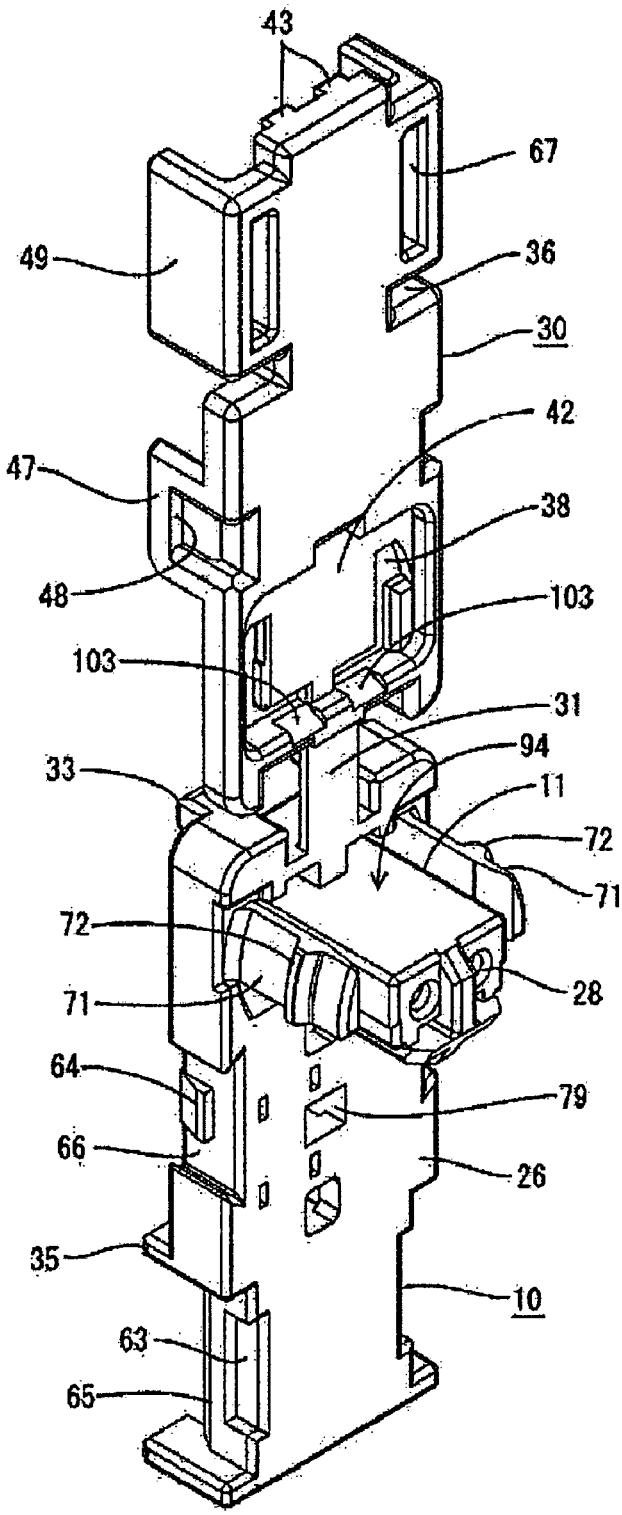
FIG. 10 is a perspective view of a cover in an open state with respect to the female housing when obliquely viewed from upper front side.
Figure 11:
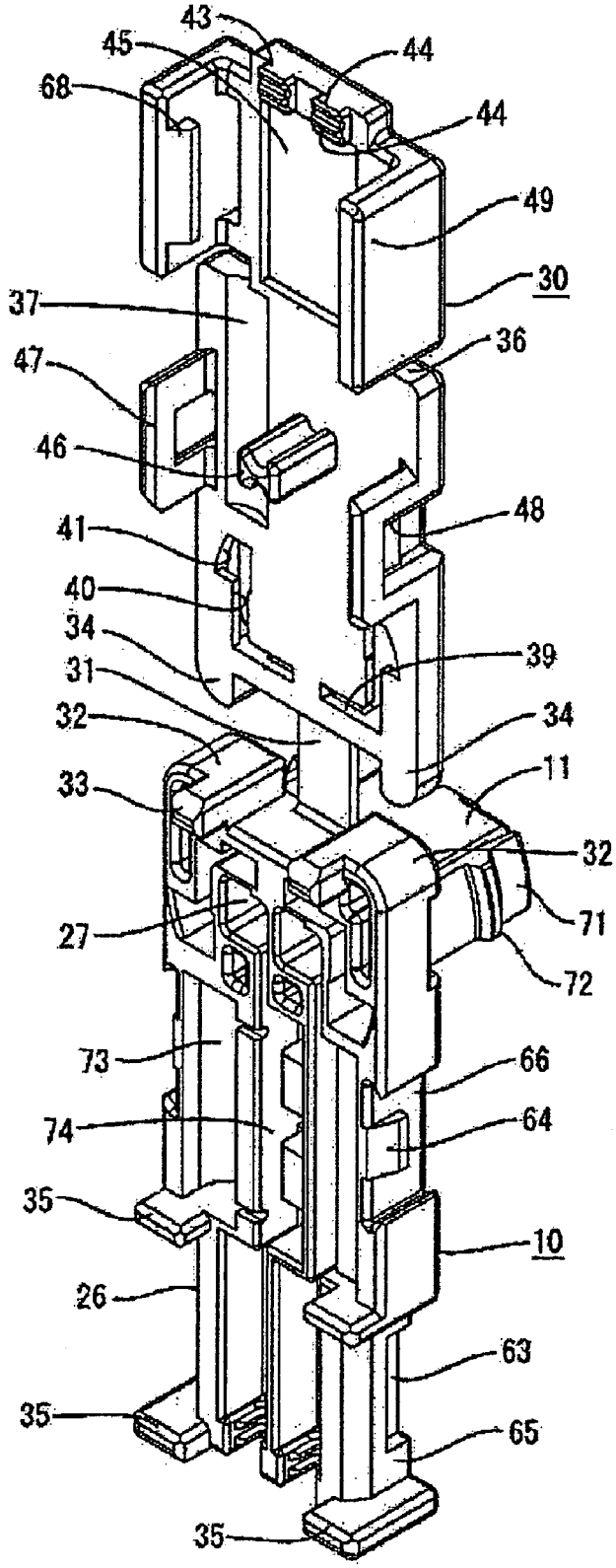
FIG. 11 is a perspective view of the cover in the open state with respect to the female housing when obliquely viewed from upper back side.

The female housing 10 is made e.g. of synthetic resin and includes an accommodating portion 26 in the form of a vertically long thick plate. A tower 11 projects forward from the upper end of the front surface of the accommodating portion 26, as shown in FIGS. 10 and 11, and can fit into the mating fitting recess 83. Two cavities 27 are formed substantially side by side in the transverse direction TD in the tower 11 at substantially the same interval as the terminal pins 84. The terminal connecting portions 15 of the terminal fittings 12 can be inserted into the cavities 27 from behind so that the terminal connecting portions 15 of the terminal fittings 12 inserted into the respective cavities 27 are oriented substantially horizontally along forward and backward directions FBD. A terminal insertion opening 28 is formed in the front wall of each cavity 27 for receiving the mating terminal pin 84 from the front. An engaging step 29 is formed at the bottom surface of the cavity 27, as shown in FIG. 24, and is resiliently engageable with the metal lock 18 when the terminal connecting portion 15 is pushed to a proper position.

Figure 7:
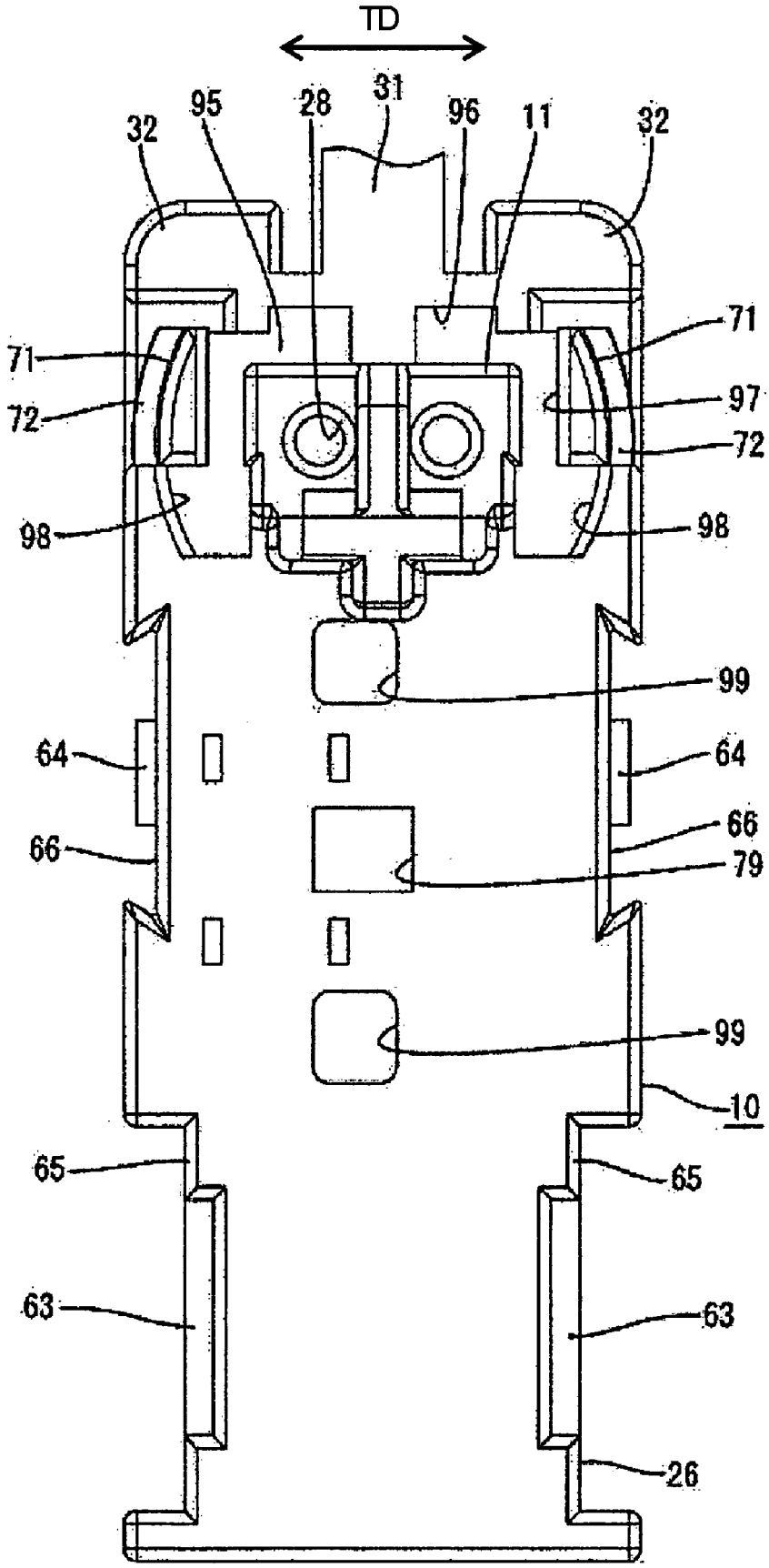
FIG. 7 is a front view of a female housing.

A detector insertion path 94 is formed around the tower 11 in the female housing 10 to permit insertion of the detector 50. A detector insertion hole 95 penetrates the accommodating portion 26 in forward and backward directions FBD and communicates with the detector insertion path 94. As shown in FIG. 7, the detector insertion hole 95 includes a first insertion hole 96 that extends along all but a middle part of the upper surface of the tower 11, second insertion holes 97 that communicate with the opposite widthwise ends of the first insertion hole 96 and extend along opposite side surfaces of the tower 11, and third insertion holes 98 that communicate with bottom ends of the second insertion holes 97 and extend along the opposite side surfaces of the tower 11. The third detector insertion holes 98 are wider in widthwise outward directions than the second detector insertion holes 97.

Two housing lock arms 71 project from the front surface of the accommodating portion 26 with the second detector insertion holes 97 and the detector insertion path 94 located therebetween. The housing lock arms 71 lock the female and male housings 10, 80 together. The outer surfaces of the housing side lock arms 71 have substantially concentric arcuate shapes so that the housing lock arms 71 are insertable along the inner circumferential surface of the mating fitting recess 83, and the third detector insertion holes 98 are formed continuously along these arcuate shapes. Housing locks 72 are formed on the outer surfaces of the housing lock arms 71 and can fit into the mating interlocking portions 88 to engage with the groove surfaces of the interlocking portions 88. Each housing lock 72 is a rib having a pointed cross section and extends circumferentially at a position slightly before the longitudinal center of the housing lock arm 71.

Figure 8:
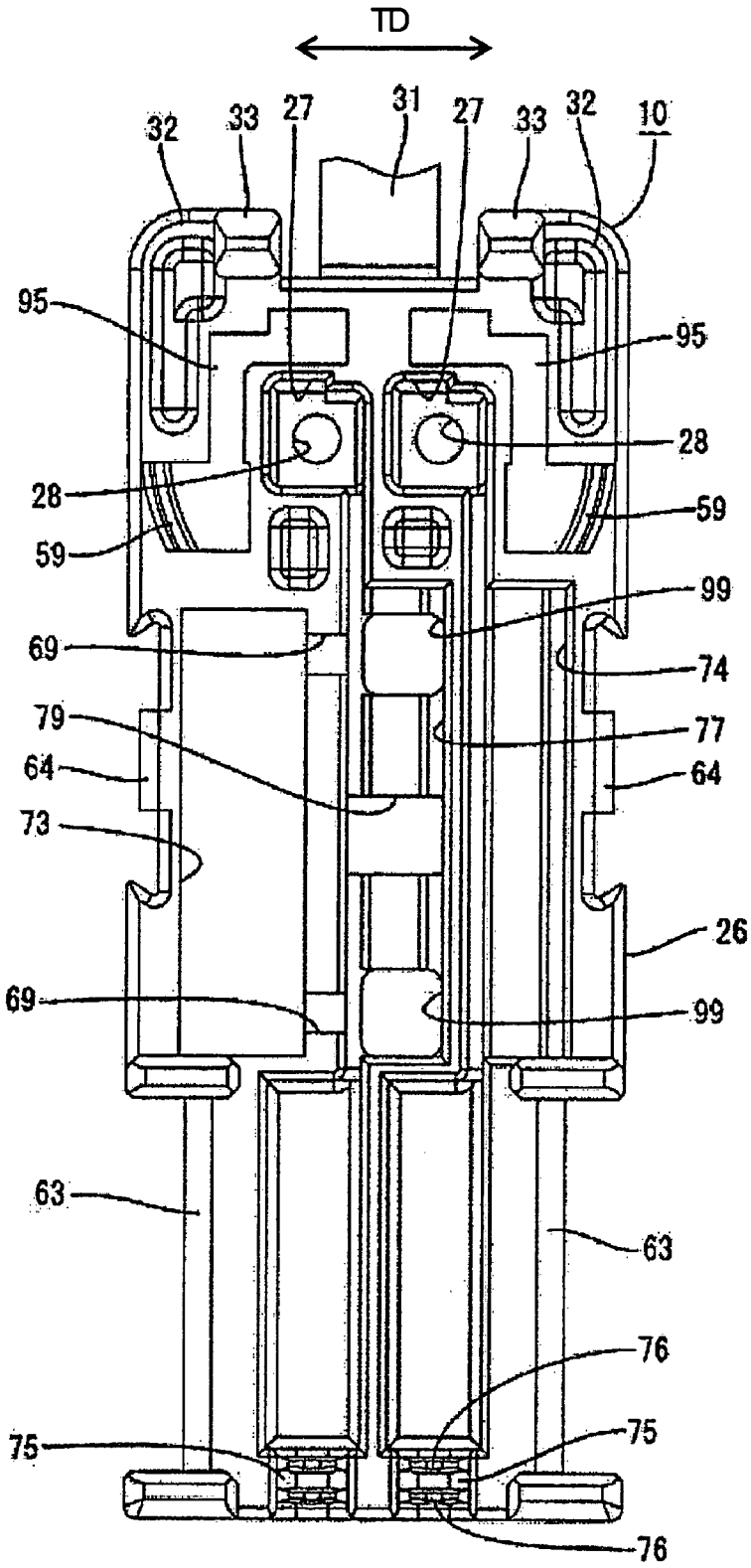
FIG. 8 is a rear view of the female housing.
Figure 9:
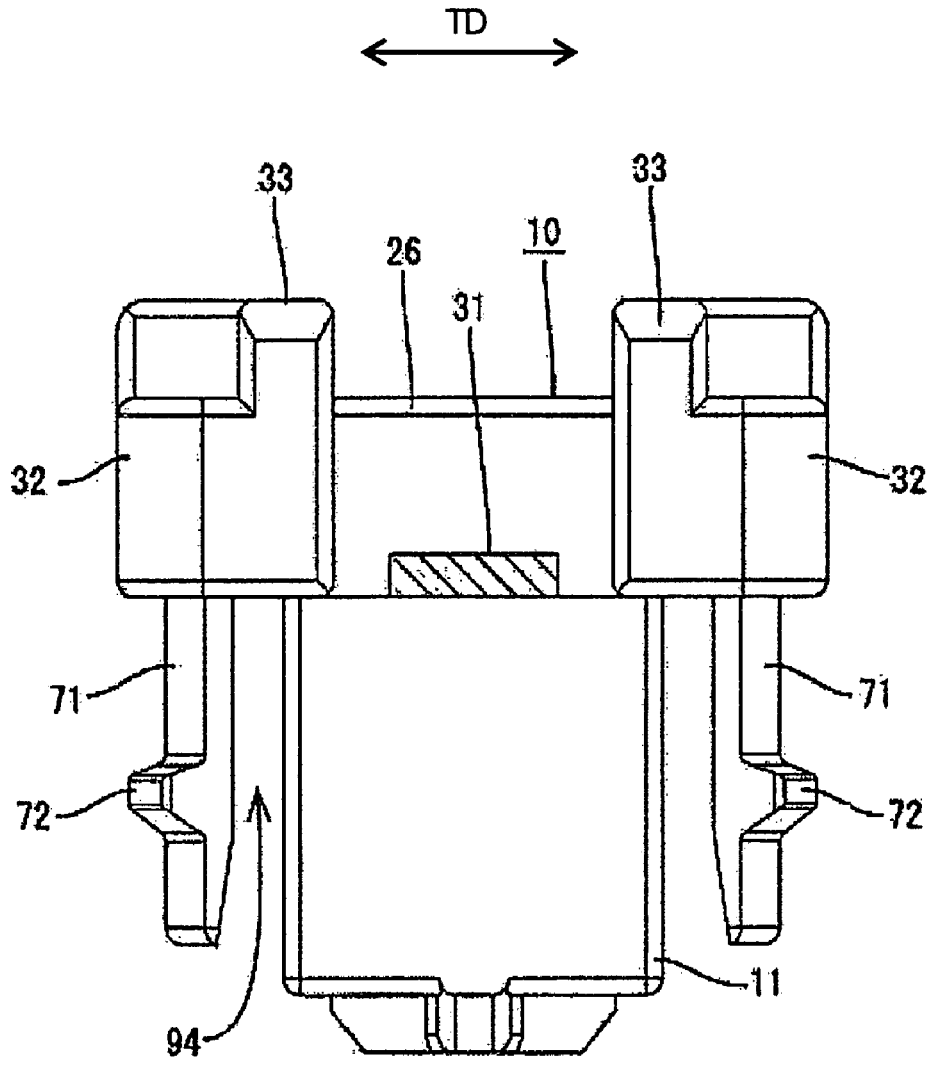
FIG. 9 is a plan view of the female housing.

Accommodating grooves 73, 74 are formed in the rear surface of the accommodating portion 26 and have open rear ends, as shown in FIG. 8, for accommodating the coil 13 and two terminal fittings 12. More specifically, the coil accommodating groove 73 is formed along one lateral edge of the accommodating portion 26 in the rear surface of the accommodating portion 26 and is configured for accommodating the coil 13. The terminal accommodating grooves 74 are adjacent the coil accommodating groove 73 and accommodate the leads 16 of the two terminal fittings 12. The two terminal accommodating grooves 74 are elongated in the height direction and are substantially side by side. More specifically, the terminal accommodating grooves 74 communicate with the cavities 27 of the tower 11 at the upper ends thereof and extend down to make openings in the bottom end surface of the accommodating portion 26. Wires 91 are drawn out of the female housing 10 through these openings. A wire draw-out groove 75 is at the bottom of each terminal accommodating groove 74 and has an arcuate cross section for accommodating the wire 91. The wire draw-out groove 75 has two biting projections 76 extending along the circumferential direction and adapted to press and fix the wire 91.

Figure 14:
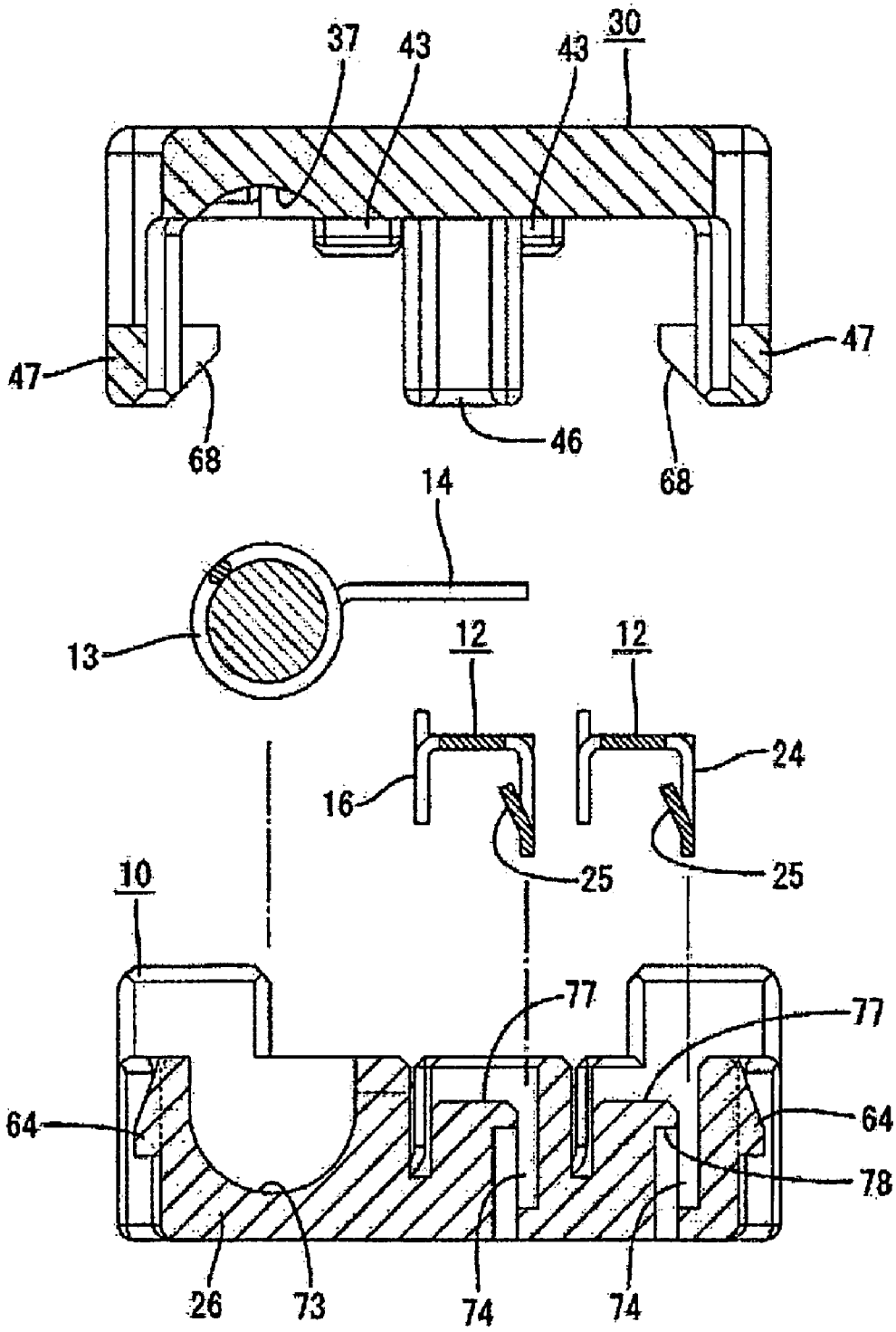
FIG. 14 is an exploded horizontal section of the female housing, the coil, the terminal fittings and the cover.

A widened-portion mounting groove 77 is defined at a position in the terminal accommodating groove 74 corresponding to the coil accommodating groove 73 and can receive the widened portion 20. The widened-portion mounting groove 77 is displaced towards the right side in FIG. 8 in conformity with the shape of the widened portion 20 of the terminal fitting 12. As shown in FIG. 14, retaining recesses 78 are formed in the inner surface of the widened-portion mounting groove 77 in the accommodating portion 26 and open in the front surface of the accommodating portion 26. The retaining recesses 78 are displaced slightly lower with respect to positions corresponding to the retaining pieces 25 of the terminal fittings 12. The retaining pieces 25 of the terminal fittings 12 engage the retaining recesses 78 of the accommodating portion 26 to prevent backward movement. An insertion window 79 extends in the forward and backward directions FBD through the bottom of the widened-portion mounting groove 77 at a position adjacent to the coil accommodating groove 73, as shown in FIG. 8. The insertion window 79 is substantially rectangular, and the rectangular breakage portion 22 of the terminal fitting 12 is punched out by press working, and is discarded through the insertion window 79.

Two windows 99 extend in the forward and backward directions FBD through the accommodating portion 26 at positions above and below the insertion window 79 along the height direction and are substantially adjacent the upper and lower ends of the widened-portion mounting groove 77. The windows 99 are located to correspond to the lead wires 14 and can be used for welding. Lead wire accommodating grooves 69 are recessed in the upper edge of a partition wall between the coil accommodating groove 73 and the widened-portion mounting groove 77 and can receive the lead wires 14 of the coil 13.

The cover 30 is in the form of a plate made e.g. of synthetic resin, and is united with the female housing 10 by a hinge 31, as shown in FIGS. 10 and 11. The cover 30 is mounted on the rear surface of the accommodating portion 26 and cooperates with the female housing 10 to sandwich and retain the terminal fittings 12 and the coil 13 in the female housing 10. The hinge 31 is a strip joined to upper ends of the cover 30 and the female housing 10. Two housing protection walls 32 project at the opposite lateral edges of the upper end of the female housing 10, and one end of the hinge 31 is between the housing protection walls 32. A guiding protrusion 33 is formed on the rear surface of each housing protection wall 32. Further, two cover protection walls 34 project at the opposite lateral edges of the upper end of the cover 30 and the other end of the hinge 31 is between the cover protection walls 34.

The cover 30 is pivotable between open and closed states about the hinge 31, and pivotal movement of the cover 30 is guided by sliding contact of the cover protection walls 34 with the outer side surfaces of the guiding protrusions 33 during the rotation of the cover 30. An angle of substantially 180° is defined between the cover 30 and the accommodating portion 26 of the female housing 10 when the cover 30 is in the open state and the hinge 31 is in a natural straight state without being bent. The cover protection walls 34 closely contact the guiding protrusions 33 and the housing protection walls 32 when the cover 30 is closed, and these parts 33, 32, 34 are at opposite sides of the hinge 31 so that the hinge 31 cannot get caught by external matter. Further, recesses 36 of the cover 30 engage projections 35 on the rear of the female housing 10 when the cover 30 is closed so that the cover 30 and the female housing 10 form part of a vertically long substantially rectangular block.

A coil holding recess 37 of arcuate cross section is formed in the inner surface of the cover 30 in the closed state at a position corresponding to the coil accommodating groove 73 of the female housing 10. Further, a detector passage 38 is formed in the cover 30 at a position corresponding to the detector insertion hole 95. The detector passage 38 has substantially the same shape as the detector insertion hole 95 of the female housing 10, and is comprised of a first detector passage hole 39 at a position to communicate with the first detector insertion hole 96, second detector passage holes 40 at positions to communicate with the second detector insertion holes 97, and third detector passage holes 41 at positions to communicate with the third detector insertion holes 98. Further, the outer surface of the cover 30 is recessed slightly to form a detector mounting recess 42 for receiving an operable portion 51 of the detector 50, and the rear end of the detector passage hole 38 has an opening in the bottom of the detector mounting recess 42.

Two wire pressing pieces 43 project at the edge of the cover 30 opposite the hinge 31 at positions corresponding to the wire draw-out grooves 75 for restricting loose movements of the wires 91. Biting projections 44 are formed at the projecting ends of the wire pressing pieces 43 similar to the female housing 10. Substantially rectangular recesses 45 are formed at a bottom end part of the front surface of the cover 30 and distanced from the wires 91 and partly surround the wires 91 when the cover 30 is closed. Further, an insulating piece 46 projects at an intermediate position on the front surface of the cover 30 and is inserted into the insertion window 79 of the female housing 10 and the dividing hole 23 of the terminal fitting 12 when the cover 30 is closed. The insulating piece 36 has a substantially hyperbolic cross section with upper and lower sides dented in widthwise middle parts, and has a projecting distance substantially equal to the depth of the insertion window 79.

Two first locking pieces 47 stand up from the front surface of the cover 30 in substantially middle parts of the opposite lateral edges with respect to the height direction. Each first locking piece 47 is in the form of a substantially rectangular frame and has a locking hole 48 in an intermediate position. Two second locking pieces 49 stand up adjacent to the corresponding first locking pieces 47 at the bottom part of the opposite lateral edges of the front surface of the cover 30. Each second locking piece 49 is in the form of a substantially rectangular plate, and a locking claw 68 projects at the extending end of the inner surface of the second locking piece 49. Mold removal holes 67 are formed in the rear surface of the cover 30 as a mold for molding the locking claws 68 is removed. On the other hand, first recesses 66 are formed on the opposite side surfaces of the female housing 10 at positions corresponding to the first locking pieces 47, and second recesses 65 are formed at positions corresponding to the second locking pieces 49. Locking projections 64 project from the inner surfaces of the first recesses 66 and engage the respective locking holes 48 of the first locking pieces 47 when the cover 30 is closed. Locking grooves 63 are formed in the bottom surfaces of the second recesses 65 and engage the respective locking claws 68 of the second locking pieces 49 when the cover 30 is closed. The outer surfaces of the first and second locking pieces 47 and 49 are substantially flush with the opposite side surfaces of the accommodating portion 26 excluding the first and second recesses 66 and 65 when the cover 30 is closed.

Figure 15:
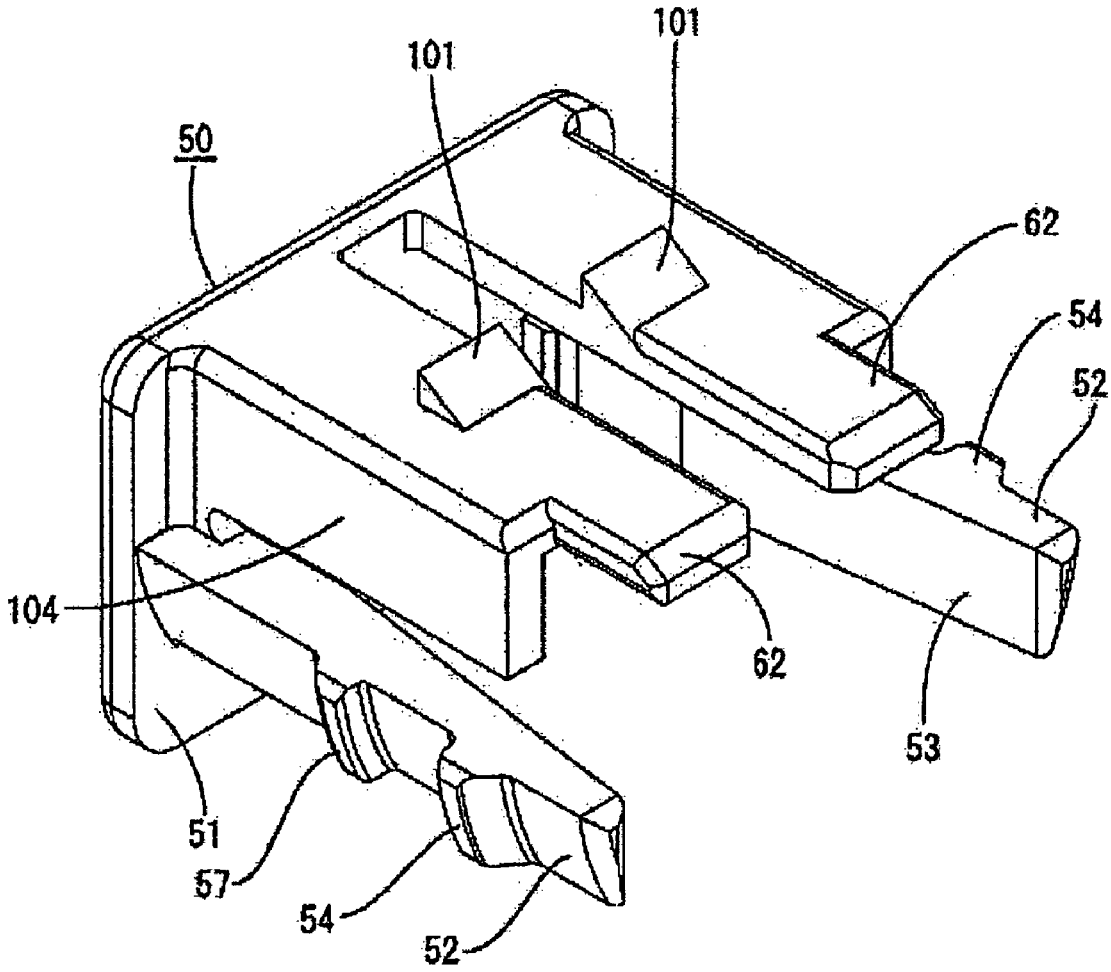
FIG. 15 is a perspective view of the detector from upper front.
Figure 16:
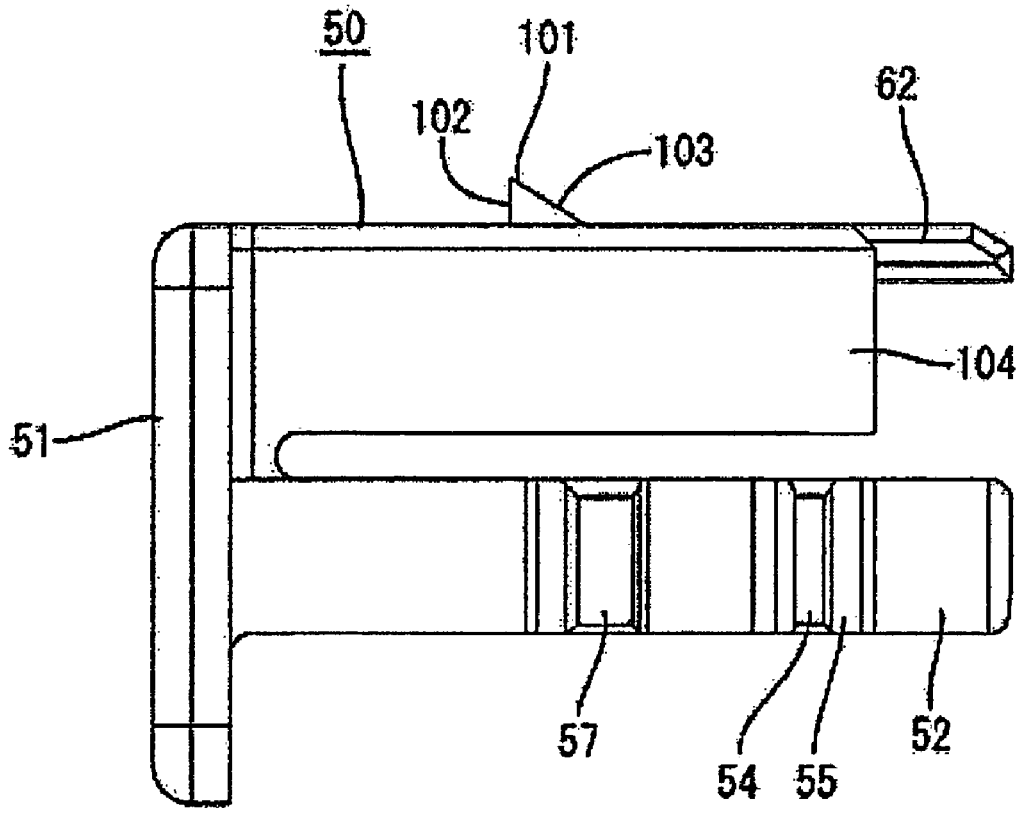
FIG. 16 is a side view of the detecting member.
Figure 17:
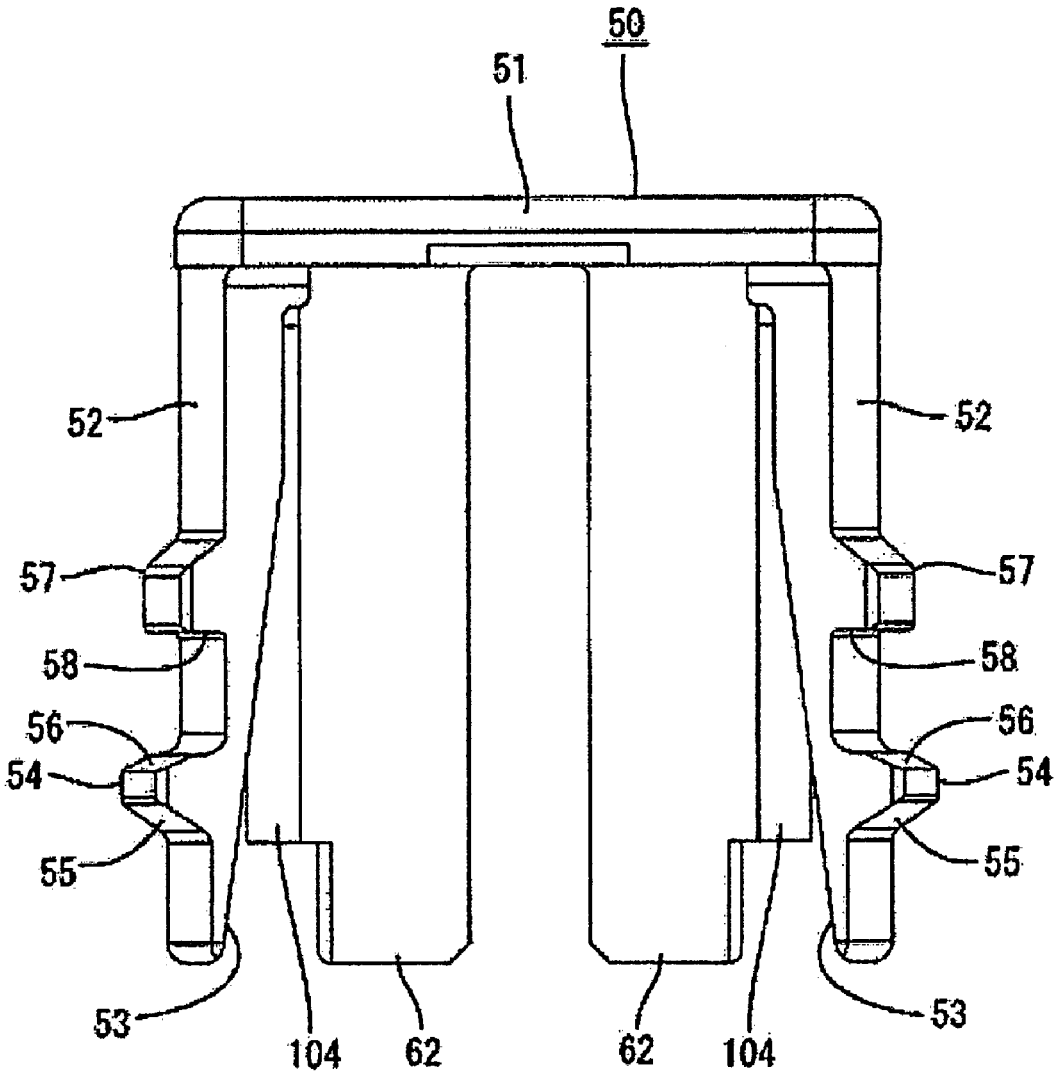
FIG. 17 is a bottom view of the detecting member.

The detector 50 is made e.g. of synthetic resin, and can be fit into the cover 30 and the female housing 10 from behind for mechanically detecting the proper connection of the two housings 10, 80. As shown in FIGS. 15 to 17, two resiliently deformable detector lock arms 52 extend in substantially forward and backward directions FBD from the detector 50 and are arranged adjacent the respective housing lock arms 71 in an assembled state of the detector 50. Specifically, the detector lock arms 52 project from the opposite lateral sides of the substantially rectangular plate-shaped operable portion 51. Thinning portions 53 are formed on inner surfaces of the detector lock arms 51 and extend obliquely out from intermediate positions of the detector lock arms 52 to widen a spacing therebetween towards the extending ends of the detector lock arms 52. Thus, the leading ends of the detector lock arms 52 are thinner than the base ends thereof.

Outer surfaces of the detector lock arms 52 have arcuate shapes substantially concentric with the outer surfaces of the housing lock arms 71, and detector locks 54 extend circumferentially near the leading ends of the outer surfaces for fitting in and resiliently engaging the groove surfaces of the interlocking portions 88. The detector locks 54 are in the form of ribs having a pointed cross section and fit into the lower areas of the interlocking portions 88. Guiding surfaces 55 are formed on the front surfaces of the detector locks 54 and are oblique to a push-in direction PID of the detector 50, whereas guiding surfaces 56 are formed on the rear surfaces of the detector locks 54 and are aligned oblique to a pull-out direction POD of the detector 50.

Push-in preventing portions 57 are formed adjacent to and behind the respective detector locks 54 on outer surfaces of the detector lock arms 52. The push-in preventing portions 57 are substantially parallel with the detector locks 54 and project a shorter distance than the detector locks 54. More specifically, the push-in preventing portions 57 have a substantially trapezoidal cross section, with have front engaging surfaces 58 that extend substantially normal to the connecting direction CD and rear surfaces that are oblique to a separating direction.

The detector 50 is movable between a push-in preventing position 1P and a locking position 2P reached by being pushed in the push-in direction PID. The operable portion 51 is spaced back from the cover 30 when the detector 50 is at the push-in preventing position 1P. However, the operable portion 51 is fit in the detector mounting recess 42 of the cover 30 so that the rear surface thereof is substantially flush with the rear surface of the cover 30 when the detector 50 is at the locking position 2P. The detector lock arms 52 are inserted into the detector insertion path 94 through the third detector passage holes 41 of the cover 30 and the third detector insertion holes 98 of the female housing 10 when the detector 50 is mounted from behind into the female housing 10 and the cover 30.

Retainers 59 are formed on the inner surface of the third detector insertion holes 98 of the accommodating portion 26 of the female housing 10, as shown in FIG. 18, and are configured for retaining the push-in preventing portions 57 in position. The retainers 59 project from the inner side surfaces of the detector insertion hole 95. Specifically, the retainers 59 are ribs that extend along the height direction at the front ends of the inner side surfaces of the detector insertion hole 95. The front surfaces of the retainers 59 are substantially continuous with the front surface of the accommodating portion 26 and gradually recede toward the projecting ends, whereas the locking surfaces 60 are formed on the rear of the retainers 59 and are aligned substantially normal to the connecting direction CD. Grooves 61 are formed behind the locking surfaces 60 of the retainers 59 and open in the rear of the accommodating portion 26. The push-in preventing portions 57 are movable back and forth in the grooves 61.

When the detector 50 is in its assembled state, the detector lock arms 52 are in contact with and right below the housing lock arms 71. Outer surfaces of the detector lock arms 52 and the housing lock arms 71 have substantially concentric arcuate shapes, and are substantially flush and continuous with each other. Particularly, when the detector 50 reaches the locking position 2P, the detector locks 54 and the housing locks 72 are aligned at substantially the same position with respect to forward and backward directions FBD are circumferentially continuous with each other.

The detector 50 also has short canceling pieces 62 for canceling a shorted state of the shorting terminal 85 of the male housing 80. Specifically, two short canceling pieces 62 project forward from the opposite sides of the upper edge of the front surface of the operable portion 51 and are arranged so that the plate surfaces thereof extend substantially vertically and substantially normal to the plate surfaces of the detector lock arms 52. The short canceling pieces 62 are inserted into the detector insertion path 94 through the first detector passage holes 39 of the cover 30 and the first detector insertion hole 96 of the female housing 10. Separation preventing portions 101 project on upper surfaces of both short canceling pieces 62 to prevent the detector 50 from separating backward. Rear surfaces 102 of the separation preventing portions 101 extend substantially vertically, and engage the front of the cover 30 in the connecting direction CD when the detector 50 is in its assembled position. Guiding slants 103 are cut in the inner upper surface of the detector mounting recess 42 in the rear surface of the cover 30 for permitting the passage of the separation preventing portions 101 when the detector 50 is assembled. The separation preventing portions 101 are at substantially the same positions as the push-in preventing portions 57 with respect to forward and backward directions FBD or at positions slightly behind them.

Two aprons 104 project forward from the front surface of the operable portion 51 of the detector 50 and are substantially continuous with the lateral edges of both short canceling pieces 62. An integral or unitary assembly of each apron 104 and the corresponding short canceling piece 62 preferably is substantially L-shaped. The aprons 104 are inserted into the detector insertion path 94 through the second detector passage holes 40 of the cover 30 and the second detector insertion holes 97 of the female housing 10. The aprons 104 are located inside the housing lock arms 71 to prevent the housing lock arms 71 from being deformed excessively inward.

The cover 30 is set in its open state with respect to the female housing 10 prior to connecting the housings 10, 80. The terminal connecting portions 15 of the terminal fittings 12 then are inserted into the cavities 27 of the tower 27, and the leads 16 of the terminal fittings 12 are inserted into the terminal accommodating grooves 74 of the accommodating portion 26. The terminal fittings 12 are crimped into connection with the wires 91 beforehand. The coil 13 then is fit into the coil accommodating groove 73 of the accommodating portion 26, and the lead wires 14 of the coil 13 are placed on the lead 16 of the terminal fitting 12 adjacent to the coil 13. The coil 13 then is welded or soldered through the windows 99 for connection with the terminal fitting 12.

Figure 6:
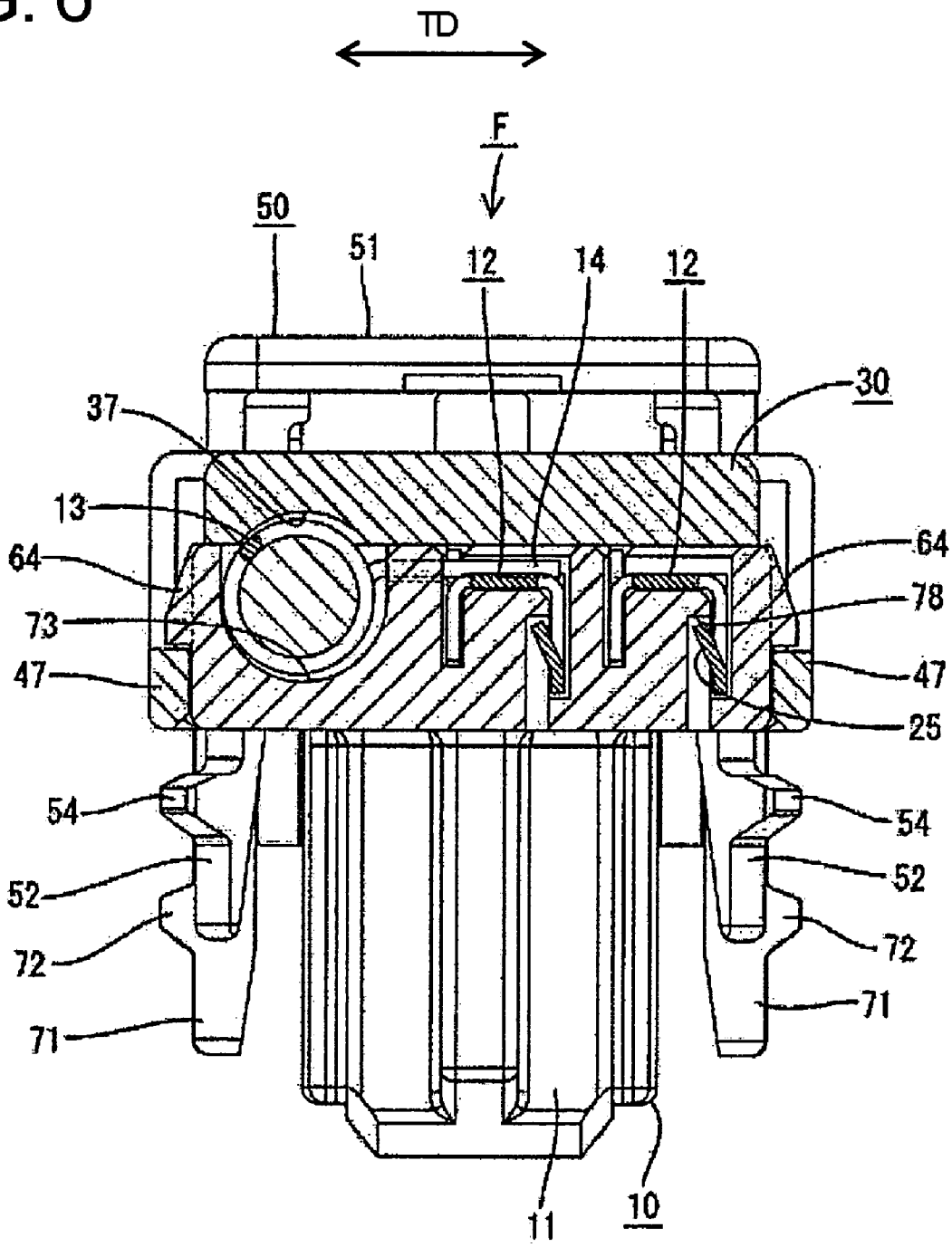
FIG. 6 is a horizontal section of the female connector.

The breakage portion 22 is punched out and separated from the terminal fitting 12 by an unillustrated punch device, as shown in FIGS. 12 and 13. The separated breakage portion 22 is discarded through the insertion window 79 of the accommodating portion 26. The dividing hole 23 is formed as the breakage portion 22 is separated, and the coil connecting portions 23 are formed at opposite sides of the dividing hole 23. The separating device would slide in contact with the edge of the dividing hole 23 and the terminal fitting 12 might move with the separating device if the separating device was returned in this state. However, the coil connecting portions 24 have the retaining pieces 25 that engage the retaining recesses 78 of the accommodating portion 26 to prevent the terminal fitting 12 from moving in the returning direction of the separating device to hinder movement of the terminal fitting 12 out of the terminal accommodating groove 74 (see FIG. 6). It should be noted that the connection of the coil 13 with the lead 16 of the terminal fitting 12 may be performed after press working or may be performed before the coil 13 and the terminal fitting 12 are assembled into the accommodating portion 26.

The cover 30 then is rotated and closed onto the rear surface of the accommodating portion 26 of the female housing 10.

Figure 5:
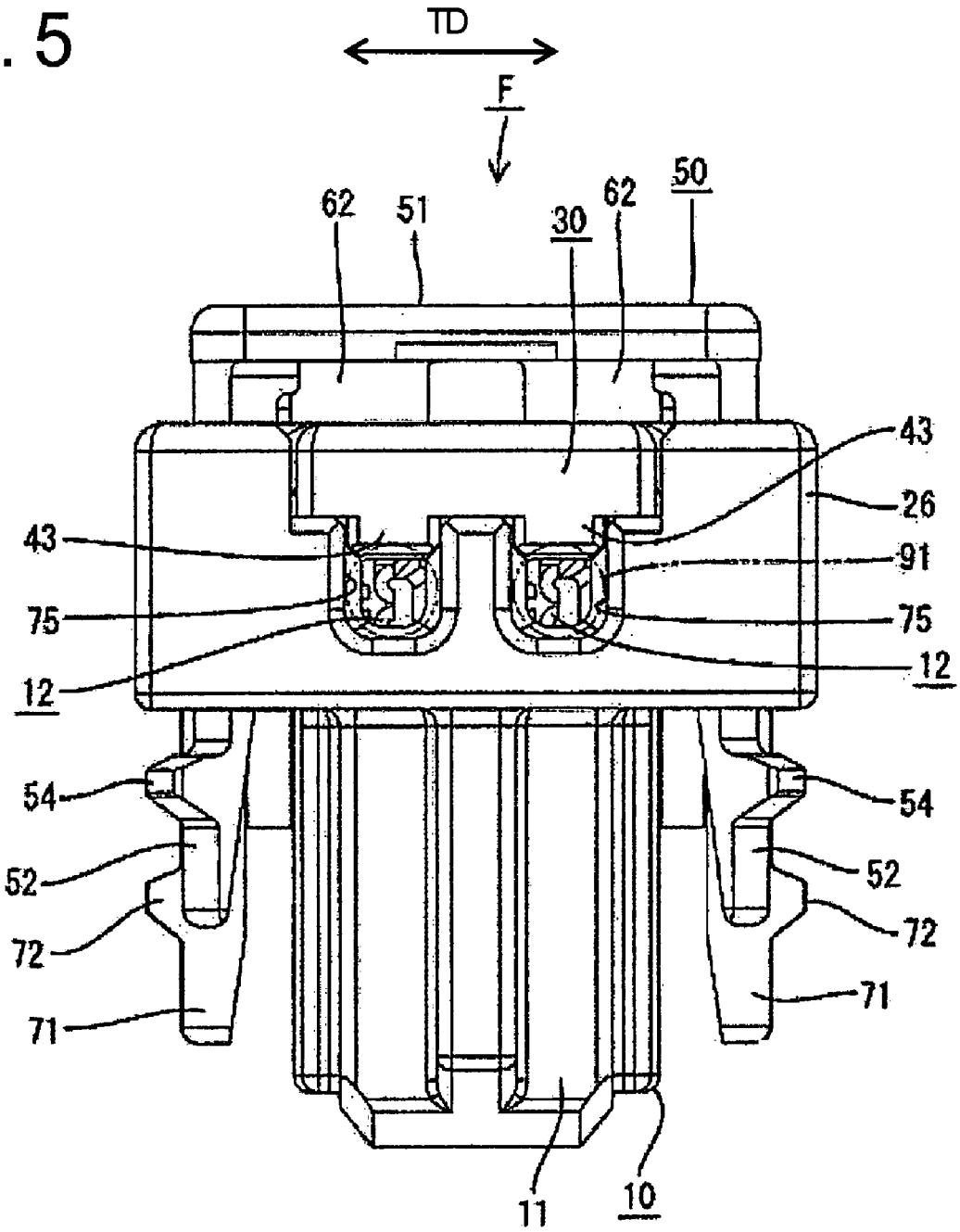
FIG. 5 is a bottom view of the female connector.

When the cover 30 is properly closed, the first locking pieces 47 enter the first recesses 66 so that the locking projections 64 of the first recesses 66 engage the locking holes 48 of the first locking pieces 47. Additionally, the second locking pieces 49 enter the second recesses 65 so that the locking claws 68 of the second locking pieces 49 engage the locking grooves 63 of the second recesses 65. The cover 30 is locked in its mounted state by these engagements. Further, the insulating piece 46 of the cover 30 is inserted into the insertion window 79 of the accommodating portion 26 through the dividing hole 23 of the terminal fitting 12 to close the dividing hole 23. As a result, the two coil connecting portions 24 are not connected with each other via a path other than the coil 13 by gaining a creepage distance. Further, as shown in FIG. 5, the wire pressing pieces 43 of the cover 30 press the wires 91 from behind to prevent loose movements.

The detector 50 is inserted from behind into the detector passage hole 38 of the cover 30 after the cover 30 has been mounted. The push-in preventing portions 57 of the detector 50 contact the retainers 59 of the accommodating portion 26, as shown in FIG. 18, when the detector 50 is inserted by a specified amount. Thus, the engaging surfaces 58 and the locking surfaces 60 are in surface contact with each other to prevent any further insertion of the detector 50 and to keep the detector 50 at the push-in preventing position 1P. In this case, the detector 50 is movable back from the push-in preventing position. However, the separation preventing portions 101 of the short canceling pieces 62 contact the front surface of the cover 30 to prevent any further backward movement of the detector 50. Accordingly, the detector 50 is movable between the retracted position and the push-in preventing position 1P, but does not move beyond this movable range.

Figure 19:
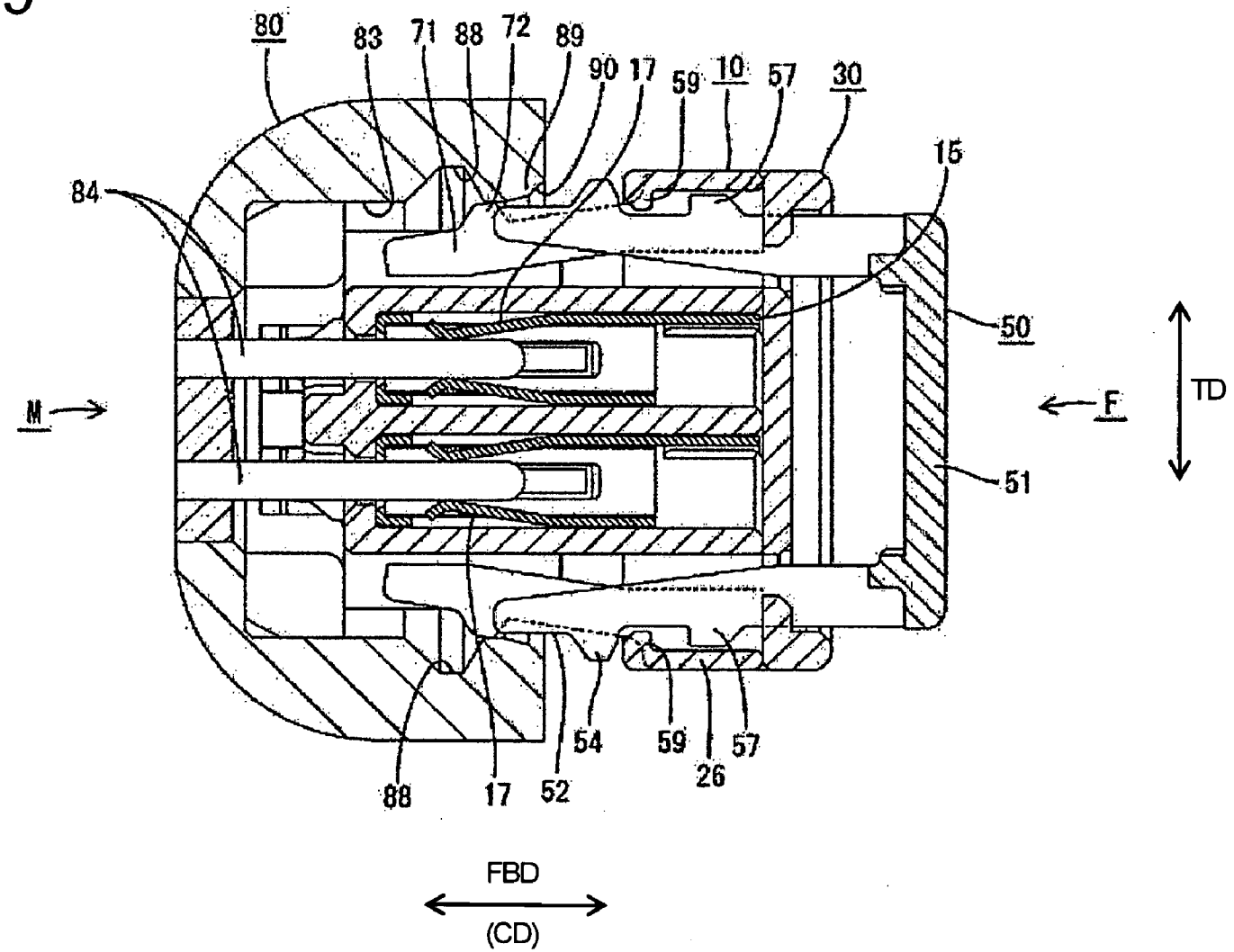
FIG. 19 is a horizontal section showing a state where housing lock arms are resiliently deformed and two housings are being connected.

The female and male housings 10, 80 are opposed to each other after the detector 50 is assembled into the female housing 10 and the cover 30. The tower 11 of the female housing 10 then is fit into the fitting recess 83 of the male housing 80 along the connecting direction CD as shown by the arrow in FIG. 18. The housing lock arms 72 contact the interfering portions 89 of the male housing 80 at the start of the connecting operation, as shown in FIG. 19. The housing lock arms 72 then slide along the guiding surfaces 90 of the interfering portions 89 and deform resiliently in. In this state, the detector lock arms 52 are at the push-in preventing positions 1P or at the retracted position so that the detector locks 54 do not reach positions to contact the interfering portions 89.

Figure 20:
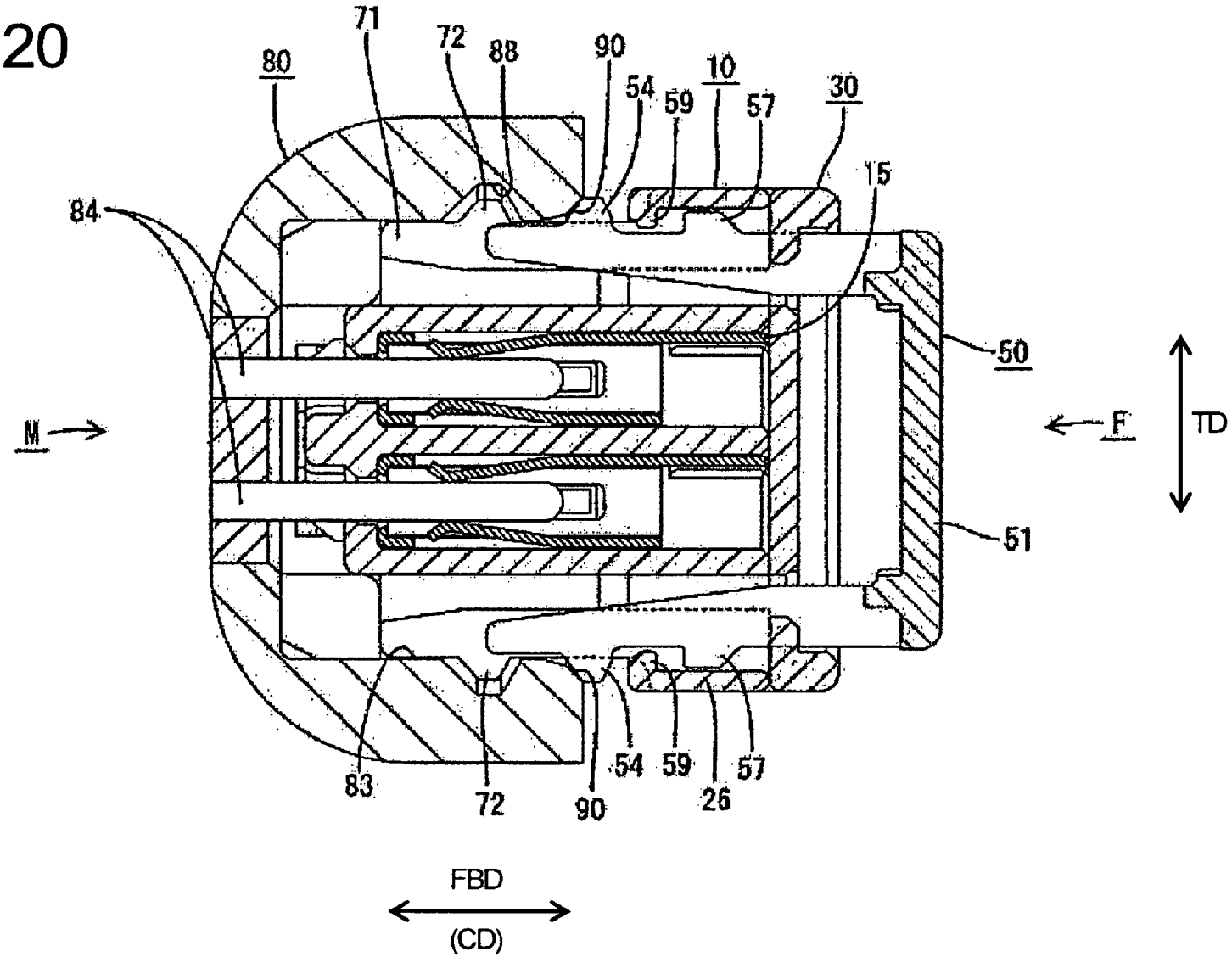
FIG. 20 is a horizontal section showing a state where the housing lock arms are restored and the two housings are properly connected.

The tower 11 of the female housing 10 then is pushed farther into the fitting recess 83 of the male housing 80. As a result, the housing locks 72 move over the interfering portions 89 and enter the upper areas of the interlocking portions 88, as shown in FIG. 20. Accordingly, the housing lock arms 71 resiliently restore and effect locking. The terminal pins 84 resiliently touch and electrically contact the contact pieces 86 of the terminal connecting portions 15 when the housings 10, 80 reach a properly connected state.

Figure 21:
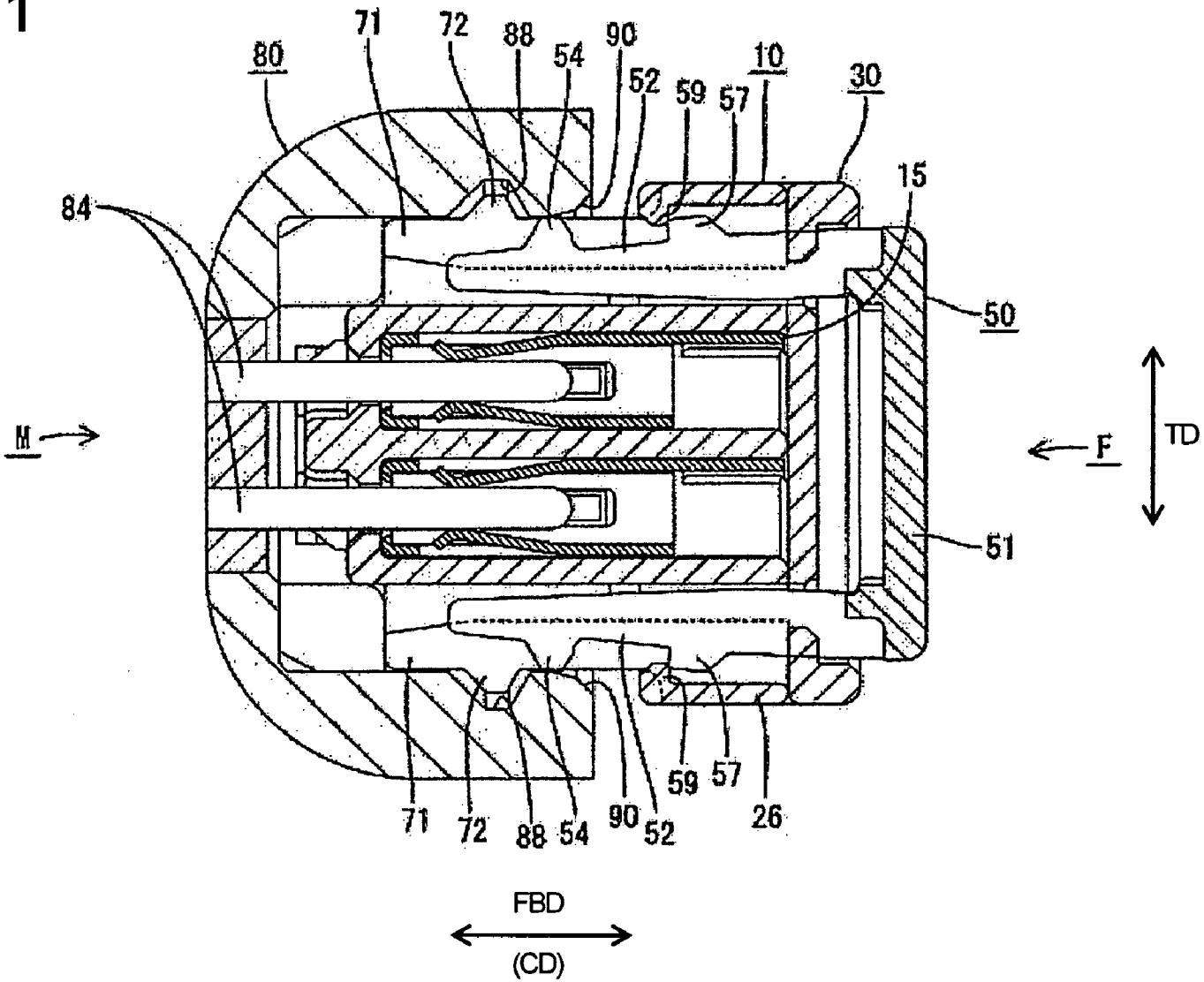
FIG. 21 is a horizontal section showing an initial state where a push-in operation of the detector is started and detector lock arms are deformed.
Figure 22:
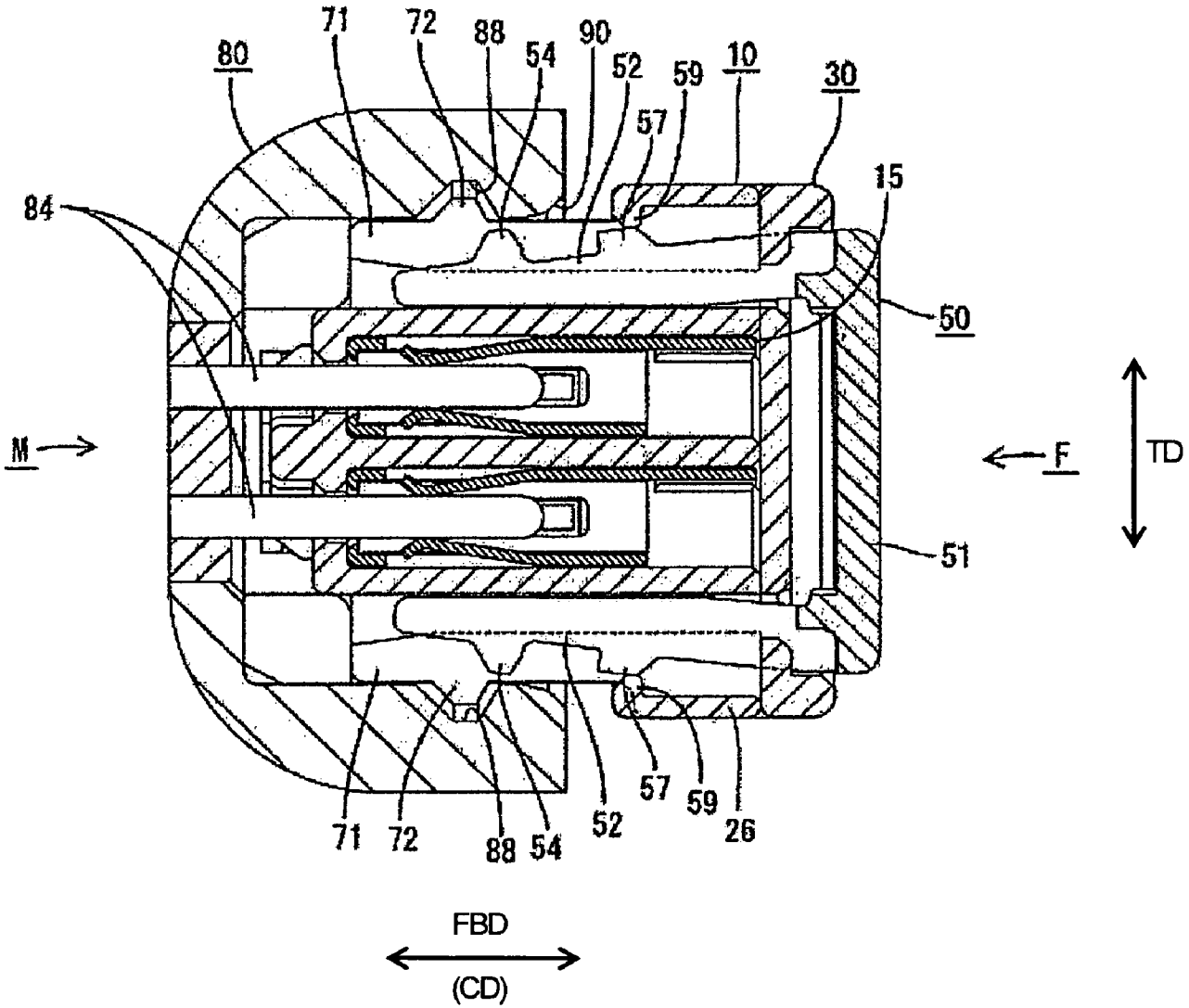
FIG. 22 is a horizontal section showing a state immediately before push-in preventing portions move over retaining portions.
Figure 23:
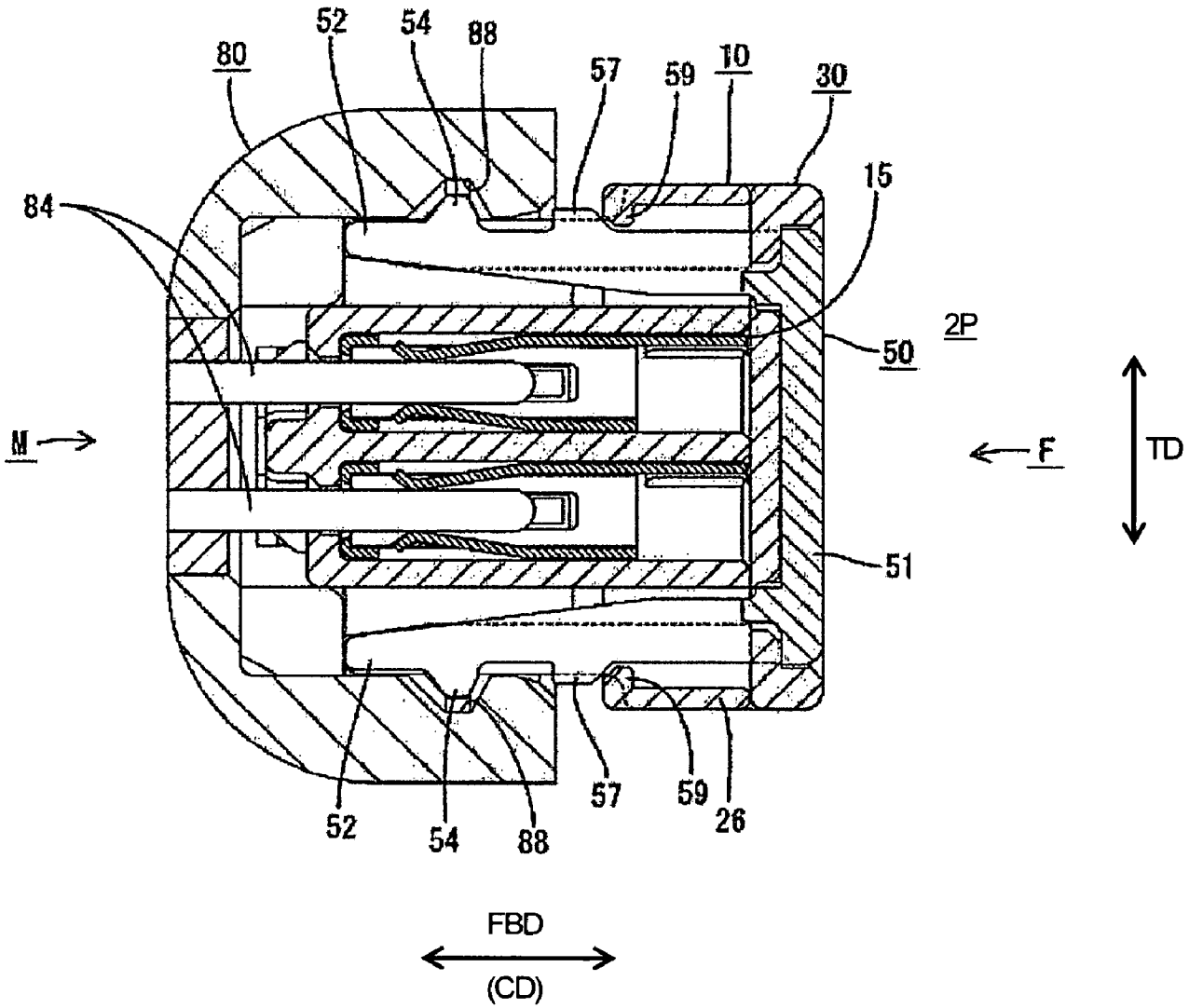
FIG. 23 is a horizontal section showing a state where the detector lock arms are restored and lock the two housings so as not to separate from each other together with the housing lock arms.

In the state described above, the guiding surfaces 55 of the detector locks 54 contact the guiding surfaces 90 of the interfering portions 89, and the push-in preventing portions 57 are spaced back from the retaining portions 59. A pushing force on the operable portion 51 while the detector 50 is in this state causes the detector locks 54 to slide along the guiding surfaces 90 of the interfering portions 89. As a result, the detector lock arms 52 deform in. The push-in preventing portions 57 contact the retaining portions 59 again during the deformations of the detector lock arms 52, as shown in FIG. 21, but the detector lock arms 52 deform in by a further pushing the detector 50, and the push-in preventing portions 57 can pass the retaining portions 59, as shown in FIG. 22. The detector lock arms 52 restore resiliently when the detector 50 is pushed to proper depth. Thus, the detector locks 54 fit into the lower areas of the interlocking portions 88 to effect locking, as shown in FIG. 23. In this way, the two housings 10, 80 are locked doubly by the detector lock arms 52 and the housing lock arms 71. The push-in preventing portions 57 face front surfaces of the retainers 59 and contact the opening edge of the detector insertion hole 95 from the front when the detector lock arms 52 reach locking positions.

In the process of pushing the detector 50, the short canceling pieces 62 of the detector 50 engage the contact pieces 86 of the shorting terminal 85 and are guided by the slants 87 into positions between the shorting terminal 85 and the outer surface of the tower 11. Thus, the shorting terminal 85 is deformed out and away from the terminal pins 84 and is separated from the terminal pins 84 to cancel the shorted state between the terminal pins 84.

The operation of connecting the female and male housings 10, 80 can be performed by pushing the operable portion 51 of the detector 50 with fingertips. In other words, pushing forces on the operable portion 51 push the tower 11 of the female housing 10 into the fitting recess 83 successively and without interruption.

An operator might stop the connecting operation before the tower 11 of the female housing 10 is pushed sufficiently into the fitting recess 83 of the male housing 80. In this case, the housing lock arms 71 are not yet engaged with the interlocking portions 88 and only the partly locked state is attained. An attempt then could be made to push the detector 50 to the locking position 2P. However, the push-in preventing portions 57 and the retainers 59 are engaged with each other and the detector 50 cannot move any further from the push-in preventing position. Specifically, the detector locks 54 either are not in contact with the interfering portions 89 or are not interfering sufficiently with the interfering portions 89 to start the deformations of the detector lock arms 52 when the detector 50 is at the push-in preventing position. On the other hand, the push-in preventing portions 57 and the retainers 59 can disengage from each other when the detector lock arms 52 can deform and cannot disengage from each other unless the resilient deformations of the detector side lock arms 52 are started. Therefore, the connected state of the housings 10, 80 can be detected based on whether the detector 50 can be pushed in.

The partly locked state can be detected if the detector 50 cannot be pushed in. In such a case, the two housings 10, 80 may be connected deeper again. The housing side lock arms 71 then engage the interlocking portions 88 so that the two housings 10, 80 are locked securely together. A movement of the detector 50 to the locking position 2P also is permitted, and the detector lock arms 52 are engaged with the interlocking portions 88 together with the housing lock arms 71.

As described above, the push-in preventing portions 57 engage the retainers 59 and prevent movement of the detector 50 to the locking position 2P unless the detector lock arms 52 are deformed by the connecting operation of the two housings 10, 80. Thus, the detector 50 cannot be pushed accidentally to the locking position 2P before the connecting operation of the two housings 10, 80 is started.

The detector lock arms 52 and the housing lock arms 71 are substantially side by side when the detector 50 reaches the locking position 2P and the detector locks 54 and the housing locks 72 are engaged with the interlocking portions 88. Thus, even if either the detector locks 54 or the housing locks 72 are accidentally disengaged from the interlocking portions 88, the two housings 10, 80 are kept locked together if the remaining ones are still engaged with the interlocking portions 88. Thus, accidental separation of the two housings 10, 80 is hindered. More particularly, the existence of the detector lock arms 52 and the housing lock arms 71 increases the locking strength between the two housings 10, 80 and hinders the accidental separation of the housings 10, 80.

Further, the push-in direction PID of the detector 50 and the connecting direction CD of the female housing 10 substantially coincide. Thus, the connecting operation can be performed while the detector 50 is pushed, and there is no need to perform the connecting operation of the two housings 10, 80 and the push-in operation of the detector 50 separately.

The outer surfaces of the detector lock arms 52 and those of the housing lock arms 71 are substantially flush with and continuous with each other. Thus, external matter is unlikely to enter between the lock arms 52 and 71 from the outside. Accordingly, external matter is not likely to deform a detector lock arm 52 or the housing lock arm 71 inadvertently.

The guiding surfaces 90 of the interfering portions 89 widen the fitting recesses 83 towards the opening edge and guide the detector locks 54 of the detector 50 smoothly into the fitting recess 83. Thus, the guiding surfaces 90 correct small displacements of the detector 50 and the interfering portions 89 in the transverse direction TD.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The cover and the female housing are united by the hinge in the foregoing embodiment. However, the cover and the female housing may be separate.

Outer surfaces of the detector lock arms and the housing lock arms are substantially flush with and continuous with each other in the foregoing embodiment. However, they may be connected by steps or may be arranged at a specified distance from each other according to the invention.

The coil and the terminal fittings are accommodated in the female housing in the foregoing embodiment. However, only terminal fittings and their wires may be accommodated in the female housing according to the invention.

The interfering portions contact the detector locks and deform the detector lock arms in the foregoing embodiment. However, the interfering portions may contact parts of the detector lock arms other than the detector locks to generate deformation according to the invention (e.g. the case where the detector locks are provided separately from the detector lock arms).

The housing lock arms may be formed on the male housing and the detector may be assembled into the male housing according to the invention.

What is claimed is:

1. A connector, comprising a housing connectable with a mating housing of a mating connector (M), the housing including at least one detector to be assembled therein for detecting a connected state of the housing with the mating housing and at least one housing lock arm for locking the housing with the mating housing, the housing lock arm being engageable with an interlocking portion in the mating housing when the housing is connected properly with the mating housing, wherein:

the detector is movable in a push-in direction with respect to the housing between a first position and a second position, and has at least one detector lock arm arranged substantially adjacent to the housing lock arm in an assembled state of the detector, the housing is formed with at least one retainer to be engaged with at least one push-in preventing portion push-in on the detector lock arm to prevent movement of the detector from the first position to the second position, the push-in preventing portion engaging the retainer to keep the detector at the first position if an attempt is made to push the detector towards the second position before the housing is connected properly with the mating housing, and the detector lock arm being resiliently deformable by sliding contact with at least one interfering portion in the mating housing if the detector is pushed to the second position when the housing is connected properly with the mating housing, the push-in preventing portion being separated from the retainer and the detector can be moved to the second position as the detector lock arm is deformed, and the detector lock arm is restored to be arranged substantially adjacent to the housing side lock arm and is engageable with the interlocking portion together with the housing side lock arm as the detector reaches the second position.

2. The connector of claim 1, wherein outer surfaces of the detector lock arm and the housing lock arm are substantially flush and continuous with the each other when the detector is in an assembled state.

3. The connector of claim 1, wherein the detector has an operable portion to be pushed when the detector is moved to the second position, at least two detector lock arms projecting substantially in the connecting direction from opposite sides of the operable portion.

4. The connector of claim 3, wherein the housing has a tower extending in the connecting direction, the detector lock arms being arranged along the opposite side surfaces of the tower.

5. The connector of claim 1, wherein the at least one detector lock arm has at least one detector lock corresponding to the interlocking portion.

6. The connector of claim 1, wherein the detector lock, has a guiding surface oblique to a moving direction of the detector to the second position, the guiding surface sliding in contact with a guide surface of the interfering portion to guide resilient deformation of the detector lock arm when the two housings are connected properly.

7. The connector of claim 1, wherein the detector has at least one short canceling piece for canceling a shorted state by a shorting terminal in the mating housing when the two housings are connected.

8. A connector assembly comprising the connector of claim 1 and a mating connector having a mating housing connectable with the housing of the connector.

9. The connector assembly of claim 8, wherein the mating housing includes at least one pair of interlocking portions substantially in correspondence with the at least one pair of detector lock arms.

10. The connector assembly of claim 9, wherein the detector lock portion has at least one guiding surface oblique to a moving direction of the detector to the second position, the interfering portion has at least one guiding surface oblique to a direction in which the detector lock arm is received, and both guiding surfaces slide in contact with each other to guide resilient deformation of the detector lock arm when the two housings are connected substantially properly.

11. The connector assembly of claim 10, wherein the mating housing has at least one shorting terminal for electrically shorting a plurality of terminal fittings in the mating housing with each other, and the detector includes at least one short canceling piece for canceling a shorted state by a shorting terminal in the mating housing when the two housings are connected.

* * * * *